US012590496B2

(12) United States Patent
Patching et al.

(10) Patent No.: US 12,590,496 B2
(45) Date of Patent: Mar. 31, 2026

(54) APPARATUS AND METHOD FOR SUPPORTING A COLLAR REGION OF A BLAST HOLE DURING DRILLING

(71) Applicant: Aquirian Technology Pty Ltd, Perth (AU)

(72) Inventors: Gregory Patching, Perth (AU); Jonathan Wright, Perth (AU)

(73) Assignee: Aquirian Technology Pty Ltd, Perth (AU)

( * ) Notice: Subject to any disclaimer, the term of this patent is extended or adjusted under 35 U.S.C. 154(b) by 0 days.

(21) Appl. No.: 18/697,284

(22) PCT Filed: Sep. 29, 2022

(86) PCT No.: PCT/AU2022/051166
§ 371 (c)(1),
(2) Date: Mar. 29, 2024

(87) PCT Pub. No.: WO2023/049964
PCT Pub. Date: Apr. 6, 2023

(65) Prior Publication Data

US 2024/0401417 A1 Dec. 5, 2024

(30) Foreign Application Priority Data

Sep. 29, 2021 (AU) ..... 2021903123
Dec. 14, 2021 (AU) ..... 2021904057

(51) Int. Cl.
*E21B 17/03* (2006.01)
*E21B 7/02* (2006.01)
(Continued)

(52) U.S. Cl.
CPC ..... *E21B 17/03* (2013.01); *E21B 7/02* (2013.01); *E21B 21/015* (2013.01); *E21B 43/10* (2013.01)

(58) Field of Classification Search
CPC . E21B 7/027; E21B 17/03; E21B 7/02; E21B 21/015; E21B 43/10
See application file for complete search history.

(56) References Cited

U.S. PATENT DOCUMENTS 1,774,884 A * 9/1930 Hansen ..... E21B 7/20 175/171
2,590,958 A * 4/1952 Goodrich ..... B23Q 11/0046 173/187

(Continued)

FOREIGN PATENT DOCUMENTS

WO WO 2019/014716 A1 1/2019
WO WO 2021/081592 A1 5/2021

OTHER PUBLICATIONS

Tecmaco Integral S.A. "Bauer BG System—Kelly System." YouTube, May 11, 2015. https://www.youtube.com/watch?v=z8OtgGrfDrA (Year: 2015).*

(Continued)

*Primary Examiner* — Robert E Fuller
(74) *Attorney, Agent, or Firm* — Leydig, Voit & Mayer, Ltd.

(57) ABSTRACT

A bore hole drilling system includes a mobile bore hole drilling platform including a mast disposed on the platform including a support for a drill string and a tube member for location within the collar region of a bore hole. The tube member includes an internal longitudinal passage for receiving a drill string therethrough and an external surface for facing outwardly against a wall of the bore hole. The system includes a coupling mechanism that is configured to couple and decouple the tube member and the drilling platform when the tube member is located coaxially within the collar region of the bore hole and substantially axially aligned with the drill string and/or the mast.

13 Claims, 18 Drawing Sheets

(51) Int. Cl.
*E21B 21/015* (2006.01)
*E21B 43/10* (2006.01)

(56) References Cited

U.S. PATENT DOCUMENTS

| | | | | |
|---|---|---|---|---|
| 3,730,285 | A * | 5/1973 | Anderson | E21B 17/10 175/122 |
| 4,202,416 | A | 5/1980 | Blaschke et al. | |
| 4,434,861 | A * | 3/1984 | Howeth | E21B 21/015 175/209 |
| 4,501,327 | A | 2/1985 | Retz | |
| 9,896,889 | B2 * | 2/2018 | Koskinen | E21C 35/223 |
| 11,988,047 | B2 * | 5/2024 | Montuori | E21B 7/26 |
| 2009/0139731 | A1 * | 6/2009 | Rieder | E21B 15/00 175/57 |
| 2016/0305234 | A1 | 10/2016 | Korherr et al. | |
| 2020/0149854 | A1 * | 5/2020 | Patching | F42D 1/08 |

OTHER PUBLICATIONS

Australian Patent Office, International Search Report in International Patent Application No. PCT/AU2022/051166, 2 pp. (Nov. 23, 2022).
Australian Patent Office, Written Opinion in International Patent Application No. PCT/AU2022/051166, 6 pp. (Nov. 23, 2022).

* cited by examiner

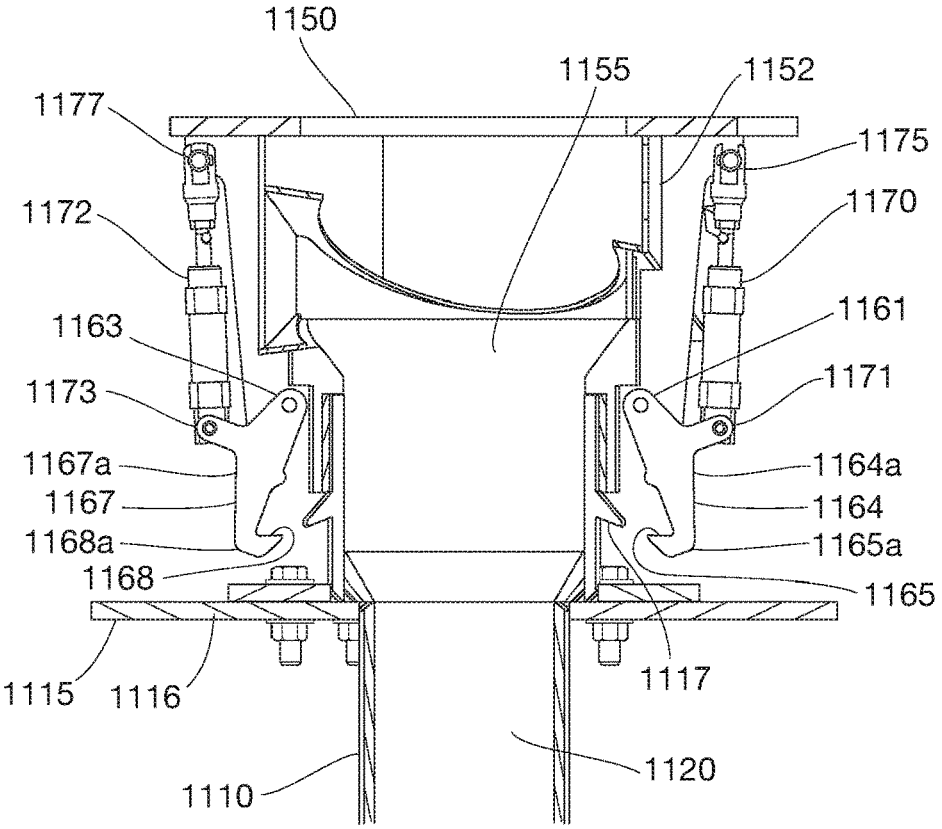
Figure 47
Figure 48
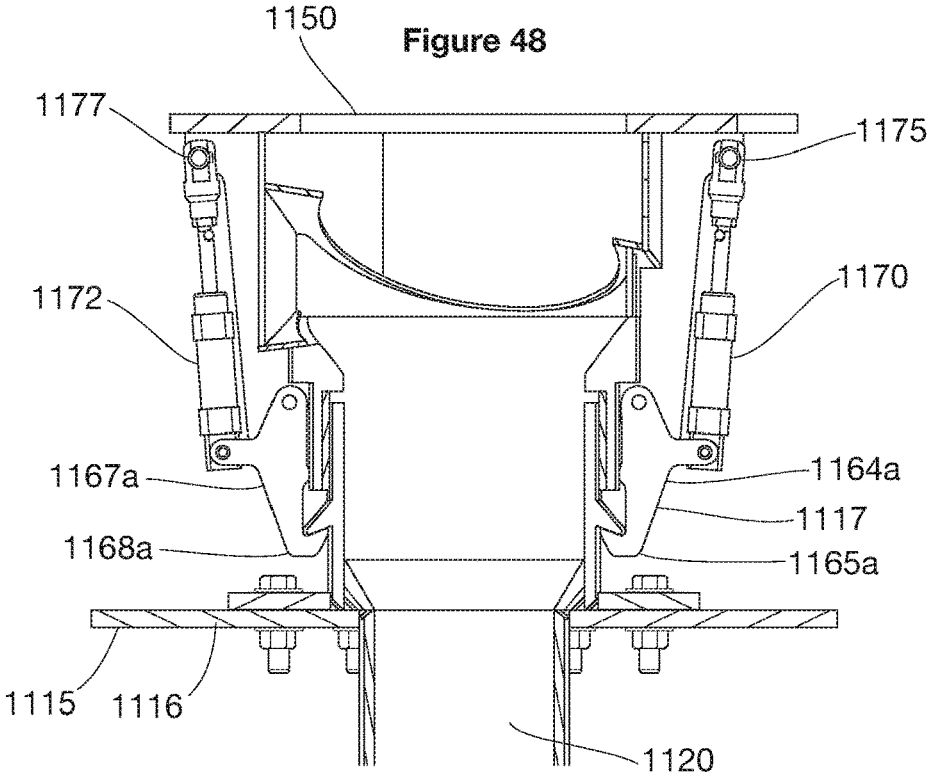

APPARATUS AND METHOD FOR SUPPORTING A COLLAR REGION OF A BLAST HOLE DURING DRILLING

This patent application is the U.S. National Phase of PCT/AU2022/051166, filed Sep. 29, 2022, which designates the U.S. and which and claims priority under 35 U.S.C. § 119(a) to Australian Patent Application No. 2021903123, filed Sep. 29, 2021, and to Australian Patent Application No. 2021904057, filed Dec. 14, 2021.

TECHNICAL FIELD

The present invention relates to the field of blast hole drilling, particularly although not exclusively in blasting operations for mining and quarrying.

BACKGROUND

Bench blasting is a process that involves drilling holes into rock to depths of up to 50 metres or more. Blast holes are typically drilled using rotary or percussive drilling equipment and techniques. The holes are then charged with an explosive and the minerals and rocks are blasted and fragmented for subsequent removal by excavators for further processing.

Significant quantities of loose rock fragments, or "preconditioned" material, can remain on the bench from the sub-drilled region after achieving the Reduced Level (RL). A preconditioned layer depth of up to 4 metres or more can improve the efficiency of the comminution process by maximising the volume of fine fragmentation that results from the subsequent blasting operation.

Drilling platforms used for drilling blast holes come in different forms and are adapted for different purposes. Smaller surface drilling platforms that are typically used for drilling bore holes of between about 89 to 165 millimetres in diameter, are commonly referred to as "crawler drilling rigs". Crawler drilling rigs are characterised by including a tracked platform with a hydraulic arm and a drilling mast attached to the end of the arm. The arm is adapted to tilt, lift and lower the mast and to locate a supporting foot of the mast on the bench surface at a location at which a bore hole is to be drilled.

Larger surface drilling platforms that are typically used for drilling bore holes of between about 165 to 351 millimetres in diameter, are commonly referred to as "platform drilling rigs". Platform drilling rigs are characterised by including a tracked platform with a drilling mast located in a fixed, vertical position relative to the platform. Locating the mast on the bench surface at a location at which a bore hole is to be drilled requires repositioning the entire platform via operation of driven tracks.

Drilling bore holes through a preconditioned layer presents a problem of loose rock fragments in the preconditioned layer falling or collapsing into the bore hole during drilling or after drilling. Applicant's patent application WO2019014716 discloses a collar support apparatus for preventing surrounding loose rock fragments from falling or collapsing into a blast hole. The apparatus includes a normally flat flexible sheet that is formed into a curved form to define a longitudinal passage and is then inserted into the open end of a blast hole. The curved sheet closely faces an internal surface of the blast hole and forms a barrier preventing surrounding loose rock fragments from falling or collapsing into the open end of the blast hole.

Drilling platforms can or may have guard cages or other physical barriers provided around the bottom of the mast as a safety measure. Accordingly, in order to access the bore hole to insert a collar support apparatus, such as the flexible sheet of Applicant's patent application WO2019014716, the mast or the entire drilling platform may have to be cleared from the open end of the blast hole to enable a worker to insert such an apparatus into the bore hole.

After the bore hole is drilled before the mast or drilling platform is cleared from the blast hole and the flexible sheet apparatus is inserted, a substantial amount of surrounding loose rock fragments in the preconditioned layer may have fallen or collapsed into the blast hole. Accordingly, a need exists for a drilling system that minimises any chance for loose rock fragments from the preconditioned layer to collapse into the bore hole during and after drilling and until the mast or the drilling platform is cleared and a collar support apparatus is deployed such as the flexible sheet apparatus described above.

Also, there exists a need for a drilling system that supports the internal surface of the blast hole in the collar region through the preconditioned layer during the drilling operation and that is practical and efficient to use with mobile drilling platforms on a blasting bench.

Any discussion of background art throughout the specification should in no way be considered as an admission that any of the documents or other material referred to was published, known or forms part of the common general knowledge.

SUMMARY OF THE INVENTION

Accordingly, in one aspect, the invention provides a bore hole drilling system including: a mobile bore hole drilling platform including a mast disposed on the platform including a support for a drill string; a tube member for locating within the collar region of a bore hole and including an internal longitudinal passage for receiving a drill string therethrough and an external surface for facing outwardly against a wall of the bore hole; a coupling mechanism that is configured to couple and decouple the tube member and the drilling platform when the tube member is located coaxially within the collar region of the bore hole and substantially axially aligned with the drill string and/or the mast; wherein the coupling mechanism includes a support body movably connected to the drilling platform and coupling elements associated with the support body and the tube member, wherein the support body is movable vertically relative to the drilling platform and/or the mast for positioning the coupling elements of the support body and the tube member relative to each other for engagement to thereby couple the support body and the tube member.

Embodiments of the invention are advantageous in that they provide a bore hole drilling system that supports the internal surface of a blast hole in the collar region through a preconditioned layer during the drilling operation. Embodiments of the invention are advantageous in that they provide a bore hole drilling system that allows for coupling and decoupling the tube member and the drilling platform when the tube member is located coaxially within the collar region of the bore hole and substantially axially aligned with the drill string and/or the mast. Once decoupled, it is possible to access the opening at the top of the tube member in the bore hole to insert a collar support apparatus, such as the flexible sheet of Applicant's patent application WO2019014716. Some embodiments of the invention are advantageous in that they provide a bore hole drilling system that allows guard cages or other physical barriers provided around the bottom of the mast to be cleared from the open end of the blast hole to enable a worker to insert a collar support apparatus into the bore hole.

Embodiments of the drilling platform include various types of mobile drilling platforms comprising a mobile, tracked platform comprising a drill mast supporting a drill string and accompanying rotary and/or percussion air blast drilling apparatus. In some embodiments, such mobile drilling platforms include smaller surface drilling platforms that are typically used for drilling bore holes of between about 89 to 165 millimetres in diameter, commonly referred to as "crawler drilling rigs" and produced by manufacturers such as Sandvik, Epiroc, Komatsu and Caterpillar. In other embodiments, such mobile drilling platforms include larger surface drilling platforms that are typically used for drilling bore holes of between about 165 to 351 millimetres in diameter, commonly referred to as "platform drilling rigs" produced by manufacturers such as Sandvik, Epiroc, Komatsu and Caterpillar.

In another aspect, the invention includes a coupling mechanism that is configured to couple and decouple a tube member and a drilling platform when the tube member is axially aligned with the drill string, the coupling mechanism including a support body for connection to the drilling platform and coupling elements associated with the support body and the tube member, wherein the support body is movable vertically relative to the drilling platform for positioning the coupling elements of the support body and the tube member relative to each other for engagement to thereby couple the support body and the tube member.

In embodiments, the coupling mechanism is configured to couple and decouple the tube member and the drilling platform when the tube member is substantially axially aligned with the drill string and/or the mast.

In embodiments, decoupling occurs when the tube member is axially aligned with the drill string and/or the mast whereby the opening in the top of the tube member can be cleared for insertion of a collar support apparatus into the longitudinal internal passage of the tube member.

Advantageously, after decoupling the drilling platform can be translated horizontally relative to the bore hole to allow any guard cages or other physical barriers provided around the bottom of the mast to be cleared from the open end of the guide tube to enable an operator to insert a collar support apparatus therein.

In embodiments the support body is movable vertically relative to the drilling platform and/or the mast for positioning the coupling elements of the support body and the tube member relative to each other for engagement to thereby couple the support body and the tube member located within the collar region of the bore hole.

In embodiments the vertical movement of the support body relative to the drilling platform or the mast, at least in part, moves the coupling elements of the support body and the tube member into and out of engagement to thereby couple and decouple the support body and the tube member located within the collar region of the bore hole.

Preferably, the coupling elements of the support body are configured to engage the coupling elements of the tube member with, at least in part, downwards axial movement of the support body relative to the tube member and to disengage, at least in part, with upwards axial movement of the support body relative to the tube member located within the collar region of the bore hole.

In embodiments the support body includes a male or a female coupling zone and the tube member includes the other one of a male or a female coupling zone, wherein the male coupling zone is adapted to be received within the female coupling zone.

In embodiments the coupling elements include a movable latch member and a static member.

Preferably, the coupling elements include one or more movable latch members that are movably connected to the support body or the elongated tube and a static member that is fixed to the other one of the support body and the elongated tube.

In embodiments, the movable latch members are movably connected to the support body or the elongated tube and the static member is fixed to the other one of the support body and the elongated tube.

In embodiments, the movable latch member and the static member are adapted to come into and out of engagement, at least in part, upon relative inwards and outwards movement, or radial movement, of the latch member and the static member.

Preferably, a plurality of the latch members are disposed radially about a longitudinal axis of the support body.

In embodiments, the latch members each include a radially movable and axially facing abutment portion and the static member includes an axially facing ledge, wherein the abutment portion is adapted for face to face contact with the ledge upon relative radial movement of the latch member and the static member.

Preferably, each one of the latch members includes an elongated portion that is pivotally connected at one end to the support body and that is connected at an opposite end to the axially facing abutment portion, wherein the latch members are pivotable towards and away from each other for engagement and disengagement with the axially facing ledge.

In embodiments, the axially facing ledge of the static member is disposed circumferentially on the outside of the elongated tube.

Preferably, linear actuators are operable cause the latch members to pivot in opposite directions relative to the support body to cause the axially facing abutment surfaces to move radially inwardly and outwardly relative to each other.

Preferably, a linear actuator is connected between the mast and the support body and is operable for moving the support body in opposite directions aligned with a longitudinal axis of the drill string and/or the mast.

In another aspect, the invention provides a bore hole drilling system including: a mobile bore hole drilling platform including a mast disposed on the platform including a support for a drill string; a tube member for locating within the collar region of a bore hole and including an internal longitudinal passage for receiving a drill string therethrough and an external surface for facing outwardly against a wall of the bore hole; and a coupling mechanism that is configured to couple and decouple the tube member and the drilling platform when the tube member is located coaxially within the collar region of the bore hole.

In embodiments the coupling mechanism includes a support body connected to the mast of the drilling platform, the support body and the tube member including coupling elements adapted to couple and decouple the support body and the tube member.

Preferably, movement of the support body horizontally relative to the tube member located within the collar region of the bore hole positions the coupling elements of the support body and the tube member for engagement to thereby couple and decouple the support body and the tube member.

In embodiments the coupling elements of the support body are configured to engage the coupling elements of the tube member located within the collar region of the bore hole with horizontal movement of the support body in one direction relative to the elongated tube and to disengage with horizontal movement of the support body relative to the elongated tube in the opposite direction.

In embodiments the support body and the tube member include first and second horizontally spaced apart co-operable pairs of coupling elements adapted to releasably couple together the support body and the tube member located within the collar region of the bore hole.

Preferably, the first pair of coupling elements includes a recess formed in the support body, wherein the recess is defined on laterally opposite sides by a pair of upwardly facing shoulders and an opening at one end defining a female coupling zone, and an annular downwardly facing ledge disposed on a radially outwardly facing surface of the tube member defining a male coupling zone.

In embodiments, the male coupling zone is reversibly received within the female coupling zone upon horizontal movement of the support body relative to the elongated tube located within the collar region of the bore hole.

Preferably, the second pair of coupling elements includes an upwards facing abutment surface formed in the support body and horizontally spaced apart from the recess, and a transverse member extending laterally from an upper end of the tube member and including a downwards facing abutment surface, wherein the upwards and downwards facing abutment surfaces are reversibly brought into face to face relation with each other with horizontal movement of the support body relative to the elongated tube located within the collar region of the bore hole.

In embodiments, the support body includes a transverse outlet opening for cuttings and/or bailings to exit the tube member, wherein the outlet opening is coupled to a flexible hose that in turn is coupled to a vacuum pump system to be directed to a desired location on the bench surface.

Preferably, the outlet opening is connected to a flow diverter for directing dry cuttings and/or bailings into one outlet and wet cuttings and/or bailings into another outlet.

Preferably, the flow diverter is configured to direct a sample of the bailings and/or cuttings to a sampling zone for holding a stationary sample for analysis by an analyser.

In another aspect, the invention provides a method of drilling a bore hole including:

coupling a tube member to a support body of a mobile drilling platform with relative movement of coupling elements associated with the support body and the tube member, wherein the tube member includes a longitudinal internal passage for receiving a drill string therethrough;

boring a hole into a bench surface and lowering the tube member within the collar region of the bore hole, the tube member including an external surface for facing outwardly against a wall of the bore hole;

decoupling the tube member and the drilling platform with relative movement of coupling elements when the tube member is located coaxially within the collar region of the bore hole;

moving the support body vertically relative to the tube member to clear an opening in the top of the tube member;

inserting a collar support apparatus comprised of a flexible sheet of material into the longitudinal internal passage of the tube member;

moving the support body vertically relative to the tube member for positioning the coupling elements of the support body and the tube member relative to each other for engagement to thereby couple the support body and the tube member; and removing the tube member from the bore hole leaving behind the collar support apparatus within the bore hole.

Preferably, the method includes the ability to decouple the tube member and the drilling platform when the tube member is substantially axially aligned with the drill string.

Preferably, in the event of decoupling, the tube member and the drilling platform, the drilling platform is translated horizontally relative to the bore hole to clear the opening in the top of the collar support apparatus and the collar support apparatus is inserted therein.

In embodiments of the method, after the collar support apparatus is inserted in the tube member the drilling platform is translated horizontally relative to the bore hole to substantially axially align the drill string with the guide tube and the tube member and the drilling platform are coupled before removing the tube member from the bore hole to thereby leave behind the collar support apparatus within the bore hole.

In yet another aspect, the invention provides a method of providing a collar support apparatus into a bore hole, the method including:

coupling a tube member to a support body of a mobile drilling platform with relative movement of coupling elements associated with the support body and the tube member, the tube member including a longitudinal internal passage for receiving a drill string therethrough;

boring a hole into a bench surface and lowering the tube member within the collar region of the bore hole, the tube member including an external surface for facing outwardly against a wall of the bore hole;

decoupling the tube member and the drilling platform with relative movement of coupling elements when the tube member is located coaxially within the collar region of the bore hole;

moving the support body vertically relative to the tube member to clear an opening in the top of the tube member and inserting a collar support apparatus comprised of a flexible sheet of material into the longitudinal internal passage of the tube member;

moving the support body vertically relative to the tube member for positioning the coupling elements of the support body and the tube member relative to each other for engagement to thereby couple the support body and the tube member; and removing the tube member from the bore hole leaving behind the collar support apparatus within the bore hole.

The tube member and the drilling platform optionally become decoupled when the tube member is located coaxially within the collar region of the bore hole and the tube member is substantially axially aligned with the drill string.

Preferably, in the event of decoupling, the tube member and the drilling platform, the drilling platform is translated horizontally relative to the bore hole to clear the opening in the top of the collar support apparatus for the collar support apparatus to be inserted therein.

In embodiments, after the collar support apparatus is inserted in the tube member the drilling platform is translated horizontally relative to the bore hole to substantially axially align the drill string with the guide tube and the tube member and the drilling platform are coupled before removing the tube member from the bore hole to thereby leave behind the collar support apparatus within the bore hole.

In still yet another aspect, the invention provides a method of drilling a bore hole including:

- coupling a tube member to a mobile drilling platform, the tube member including a longitudinal internal passage for receiving a drill string therethrough;
- boring a hole into a bench surface and lowering the tube member within the collar region of the bore hole, the tube member including an external surface for facing outwardly against a wall of the bore hole;
- decoupling the tube member and the drilling platform when the tube member is located coaxially within the collar region of the bore hole;
- clearing an opening in the top of the collar support apparatus;
- inserting a collar support apparatus comprised of a flexible sheet of material into the longitudinal internal passage of the tube member; and
- removing the tube member from the bore hole leaving behind the collar support apparatus within the bore hole.

BRIEF DESCRIPTION OF THE FIGURES

The present invention will now be described in more detail with reference to preferred embodiments illustrated in the accompanying figures, wherein:

FIGS. 47 to 49 illustrate a side section view of the coupling mechanism and the tube member of FIGS. 32 and 34 wherein in FIG. 47 the tube member and the support body are uncoupled, in FIG. 48 the tube member and the support body are coupled together and in FIG. 49 the tube member and the support body are uncoupled and the support body has cleared the top of the tube member.

Figure 1:
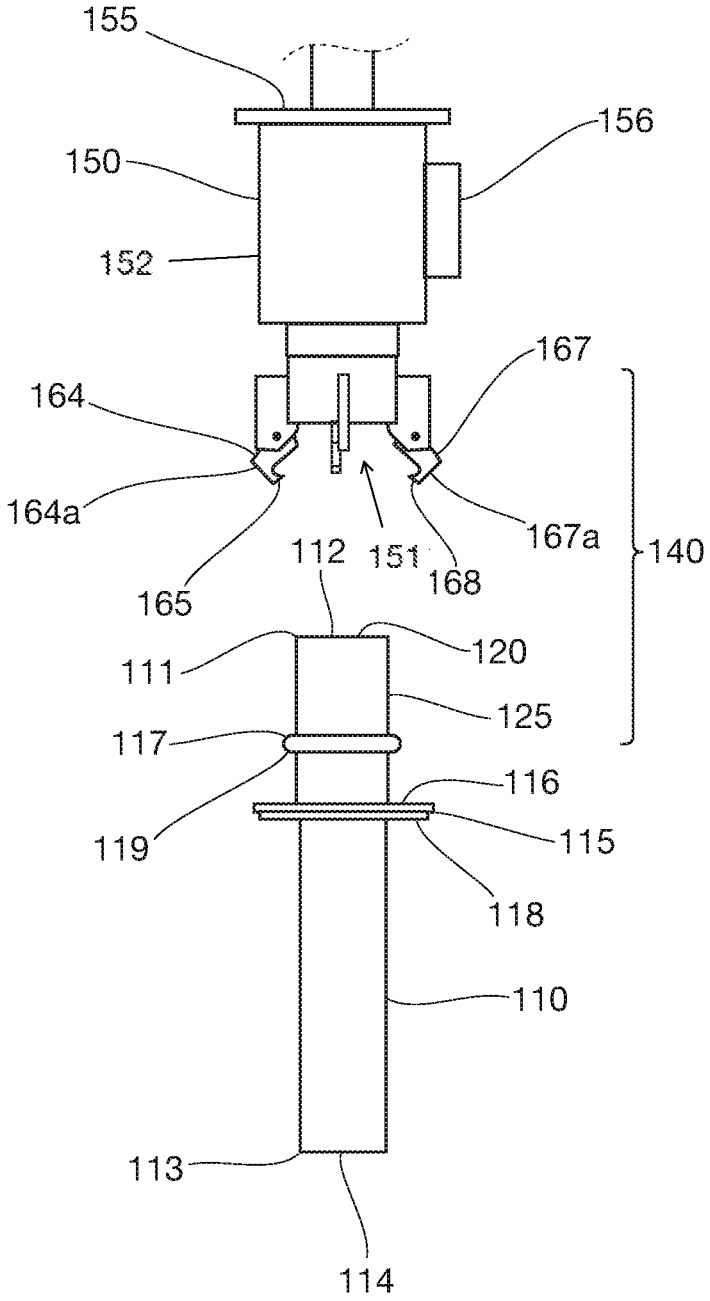
FIG. 1 illustrates a side view of a tube member for locating coaxially within the collar region of a bore hole and a coupling mechanism that is configured to couple and decouple the tube member and a drilling platform in accordance with an embodiment of the invention.

The invention will now be described in further detail with reference to the embodiments illustrated in the Figures.

DETAILED DESCRIPTION

Blast-hole drilling is a technique that is used in the extraction of minerals and rock products from surface mines and quarries. A bore-hole drill produces bore holes according to a predetermined pattern and depth. The holes are then charged with explosive and the minerals and rocks are blasted and fragmented for subsequent removal by excavators for further processing. Significant quantities of loose rock fragments, or "preconditioned" material, can remain on the bench from the sub-drilled region after achieving the Reduced Level (RL). A preconditioned layer depth of up to 4 metres or more can improve the efficiency of the comminution process by maximising the volume of fine fragmentation that results from the subsequent blasting operation.

Referring to FIGS. 1 to 10 there is illustrated an embodiment of a bore hole drilling system 10 including a mobile bore hole drilling platform 20 including a mast 30 disposed on the platform 20. The mast 30 includes a support for a drill string 40. The system includes a tube member 110 for locating within the collar region of a bore hole 2. The tube member 110 includes an internal longitudinal passage 120 for receiving the drill string 40 therethrough and an external surface 125 for facing outwardly against a wall 4 of the bore hole 2. The system 10 includes a coupling mechanism 140 that is configured to couple and decouple the tube member 110 and the drilling platform 20 when the tube member 110 is located coaxially within the collar region of the bore hole 2.

The embodiment of the mobile drilling platform 20 illustrated in the figures is a class of surface drilling platform that is typically used for drilling bore holes of between about 89 to 165 millimetres in diameter, commonly referred to as "crawler drilling rigs". However, it is to be appreciated that embodiments of aspects of the invention are applicable to classes of larger surface drilling platforms that are typically used for drilling bore holes of between about 165 to 351 millimetres in diameter, commonly referred to as "platform drilling rigs". Platforms of the smaller and larger classes are known to originate from various manufacturers such as Sandvik, Epiroc, Komatsu and Caterpillar to name but a few.

The drilling platform 20 comprises a self-propelled vehicle 22 including a hydraulic arm 24 that supports the mast 30. The mast 30 itself is adapted to support the drill string 40 comprised of a plurality of drill rods 45 and a bit 47 at the end of the drill string 40. The drill rods 45 are coupled together by threaded connections therebetween.

In one aspect, the invention is directed to a tube member 110 adapted to be coupled to the mast 30 in a manner that will be described in more detail below. In another aspect, the invention is directed to the combination of the mobile drilling platform 20 and the tube member 110.

The mast 30 carries a drilling head 25 including a reciprocating piston or hammer assembly and a rotary assembly which together are adapted to apply percussive force and rotational torque to the drill string 40. The drilling head 25 can be raised and lowered by a hydraulically driven up-down feed system to enable pipes or rods to be removed from, or added to, the drill string 40.

The mast 30 contains a store of a plurality of the drill rods 45. During a drilling operation, when the top of the uppermost drill rod 45 reaches the bottom of the mast 30 a subsequent drill rod 45 is swung into position by the drill rod feed system and into axial alignment with the uppermost drill rod 45 of the drill string 40. The drilling head 25 engages and rotates the subsequent drill rod 45 to threadedly couple with the top of the drill rod 45 below. The drilling head 25 then resumes drilling by applying percussive force and rotational torque to the drill string 40.

As illustrated in FIG. 1, the tube member 110 is adapted to be located within the bore hole 2 that has been drilled or is in the process of being drilled by the drilling rig 10. Preferably, the tube member 110 is formed of a rigid and durable material such as metal (e.g. mild steel). The tube member 110 is configured to be releasably coupled to the bottom of the mast 30. When coupled to the mast 30, the longitudinal internal passage 120 of the tube member 110 is adapted to be aligned with the axis of the drill string 40 to receive the drill string 40 therethrough.

The external surface 125 of the tube member 110 is adapted for facing outwardly against the wall 4 of the bore hole 2. The diameter of the external surface 125 of the tube member 110 is ideally slightly greater, or slightly less or about the same as the diameter of the drill bit 47. The diameter of the external surface 125 of the tube member 110 is ideally slightly greater, or slightly less or about the same as the diameter of the bore hole 2 to be formed thereby. Accordingly, different diameter tube members 110 may be provided for use with different diameter drill bits 47 and/or different diameter bore holes 2.

In some bore hole drilling operations, a preconditioned layer depth of up to 4 metres or more can be employed. The section of the bore hole 2 in the preconditioned layer is referred to as the "collar". The preconditioned layer is comprised of fragmented rock which can consist of a wide range of particle sizes including fine, medium, and coarse with ranges of 1 mm to 100 mm or more. The tube member 110 is adapted to provide temporary support for the wall 4 of the bore hole 2 in the collar region, both during the drilling operation and after the bore hole 2 has been drilled to the desired depth.

In embodiments, the tube member 110 is adapted to receive a collar support apparatus 200 therewithin and the tube member 110 is adapted to be removed to leave behind the collar support apparatus 200 within the bore hole 2. The remaining collar support apparatus 200 is left in place to prevent loose rock fragments in the preconditioned layer from falling or collapsing into the bore hole 2. The drilling platforms 20 can then move to the location at which the next bore hole 2 is to be drilled.

The collar support apparatus 200 includes a flexible sheet including a pair of opposite surfaces and a pair of spaced apart longitudinally extending side edges and a pair of spaced apart laterally extending end edges. The normally flat sheet being adapted, in use, to be formed into a curved, substantially cylindrical shape to define a longitudinal passage extending between openings at longitudinally opposite ends.

FIGS. 1 to 10 illustrate an embodiment of the coupling mechanism 140. In particular, the coupling mechanism 140 includes a support body 150 movably connected to the drilling platform 20 and coupling elements adapted to couple and decouple the support body 150 and the tube member 110 with the tube member 110 substantially axially aligned with the drill string 40.

Figure 2:
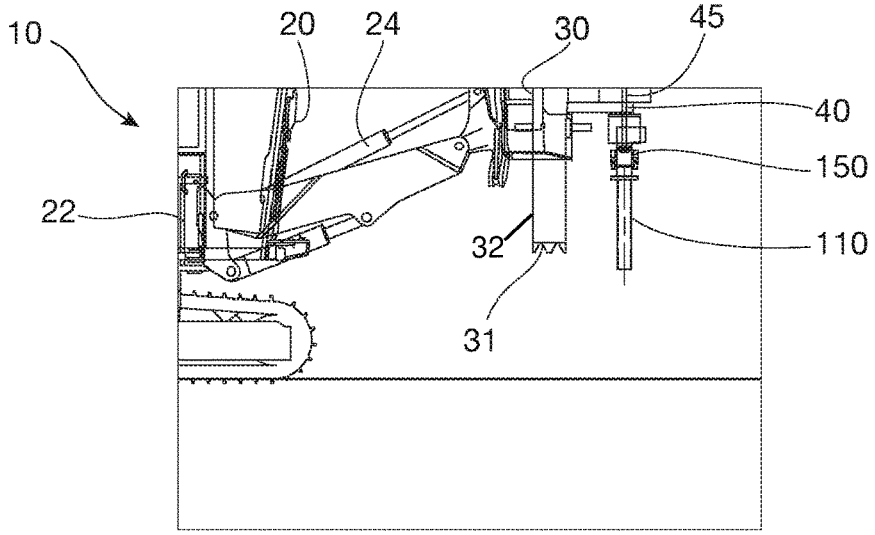
FIGS. 2 to 10 illustrate a sequence of steps in a method of drilling a bore hole and providing a collar support apparatus into the bore hole in accordance with an embodiment of the invention by reference to a set of side views of a portion of a drilling platform including a drill mast and the coupling mechanism and the tube member of FIG. 1.

Referring to FIGS. 1 and 2, the tube member 110 has openings 112, 114 at opposite ends 111, 113 thereof. The longitudinal passage 120 extends between the openings 112, 114.

Near one of the ends 111 the tube member 110 includes an annular rib 117 on the external surface 125 located a distance away from the end 111 of about 100 mm, or about 200 mm, or about 300 mm, or about 400 mm or any increment therebetween. As described in further detail below, the rib 117 comprises a coupling element and is operable for facilitating connection between the tube member 110 and the support body 150.

The tube member 110 also includes a flange 115 extending radially outwardly from the external surface 125. The flange 115 is located further from the end 111 of the tube member 110 than the rib 117. The flange 115 is comprised of a plate which may be welded or otherwise fixed or formed integral with the external surface 125 of the tube member 110. The flange 115 illustrated in the Figures is a substantially planar, annular member fixed, such as by welding, to the external surface 125 of the tube member 110.

The flange 115 has a preferably round, oval or a polygonal shape with opposite top 116 and bottom surfaces 118. The bottom surface 118, in use, is adapted to engage the surface of the bench 6 surrounding the open end 5 of the bore hole 2. The flange 115 is adapted to support the tube member 110 in the collar region of the bore hole 2.

Referring to FIGS. 1 to 10, the support body 150 is configured to be secured to the mast 30 of the drilling platform 20. The bottom of the mast 30 includes a foot pad 31 that in some circumstances is adapted to engage the bench surface during a drilling operation to at least partially support and maintain the stability of the mast 30. A riser 32 extends upwardly from foot pad 31 to the bottom of the mast 30.

The support body 150 is connected to the mast 30 by a mechanism that permits vertical movement of the support body 150 (i.e. up and down movement) relative to the mast 30. A linear actuator (not shown) is connected between the mast 30 and the support body 150 and is operable for actuating the support body 150 in opposite directions (i.e. up and down) substantially aligned with a longitudinal axis of the drill string 40 and/or the mast 30.

As described above, the rib 117 on the external surface 125 of the tube member 110 comprises a coupling element and is operable for facilitating connection between the tube member 110 and the support body 150. The rib 117 is fixed and does not move and therefore comprises a static member. The rib 117 includes a bottom surface that defines a downwardly facing annular ledge 119.

The support body 150 also includes coupling elements comprised of movable latching members 164, 167. The movable latching members 164, 167 are comprised of elongated members or legs 164*a*, 167*a* that are pivotally coupled at one end to the support body 150. The other end of each of the elongated members 164*a*, 167*a* include axially facing abutment surfaces 165, 168. The movable latch members 164, 167 are pivoted, such as by a hydraulic or pneumatic actuator, to open and close in a manner resembling opening and closing jaws. Referring to FIG. 1, a plurality of the latch members 164, 167 are disposed radially about a longitudinal axis of the support body 150.

When the latch members 164, 167 are open they define a recess 151 for receiving the end 111 of the tube member 110. Closing the latch members 164, 167 brings the axially facing abutment surfaces 165, 168 into face to face contact with the ledge 119 of the rib 117 on the tube member 110 to thereby retain the support body 150 and the tube member 110 together. When closed, the latch members 164, 167 engage the rib 117 radially about the circumference of the tube member 110.

In another configuration the movable latch members 164, 167 coupled to the support body 150 can engage the static member or the rib 117 on the tube member 110 upon radially inwards movement towards the tube member 110. Alternatively, the movable latch member may be associated with or mounted on the tube member 110 that with radially outwards movement engages a static member associated with or mounted on the support body 150.

Referring to FIGS. 1 to 19, the support body 150 includes housing 152 defining an axial opening 155 or chamber that is adapted to receive the drill string 40 therethrough. When the tube member 110 is coupled to the support body 150 the internal passage 120 of the tube member 110 is aligned with the axial opening 155 of the support body 150 in order that the drill string 40 may simultaneously pass through both.

During drilling cuttings and/or bailings that emerge from the bore hole 2 travel up through the longitudinal passage 120 of the tube member 110 and emerge out of the opening 112. The cuttings and/or bailings that emerge out of the opening 112 of the tube member 110 are directed up into the axial opening or passage 155 within the support body 150. The support body 150 includes a transverse outlet opening 156 for the cuttings and/or bailings to exit the axial opening or passage 155 within the support body 150. The outlet opening 156 can be coupled to a flexible hose that in turn is coupled to a vacuum pump system or may be otherwise directed to a location at which they are deposited on the bench surface.

The recess 151 defined by the latch members 164, 167 mounted to the support body 150 comprises a female coupling zone for receiving a male coupling zone comprised of the end 111 of the tube member 110.

The recess 151 defined by the latch members 164, 167 is open downwardly and axially and is configured to receive the end 111 of the tube member 110 upon axial movement of the support body 150 relative to the tube member 110. When the end 111 of the tube member 110 is received within the recess 151 the latch members 164, 167 are positioned relative to the annular rib 117 on the external surface 125 of the tube member 110 so that actuation of the latch member 164, 167 to close them together brings them into engagement with the rib 117 in the manner described above. Conversely, actuation of the latch member 164, 167 to open them apart disengages them from the rib 117 and subsequently the support body 150 moves axially upwardly to clear the end 111 of the tube member 110.

Accordingly, the vertical movement of the support body 150 relative to the drilling platform 20 and/or the mast 30, at least in part, moves the coupling elements, including the latch members 164, 167, of the support body 150 and the tube member 110 into and out of engagement to thereby couple and decouple the support body 150 and the tube member 110 located within the collar region of the bore hole 2.

The coupling elements, including the latch members 164, 167 of the support body 150 are configured to engage the coupling elements of the tube member 110, namely the rib 117, with, at least in part, downwards axial movement of the support body 150 relative to the tube member 110 and to disengage, at least in part, with upwards axial movement of the support body relative to the elongated tube located within the collar region of the bore hole.

The tube member 110 and the support body 150 are configured so that the tube member 110 can be positioned within the collar region of the blast hole 2 and the support body 150 can be raised to clear to the end 111 of the tube member 110. The collar support apparatus 200 can then be inserted into the internal passage 120 of the tube member 110. The tube member 110 and the support body 150 can then be reengaged and lifted out of the bore hole 2 to leave behind the collar support apparatus 200 in the bore hole 2.

In an embodiment, the platform 20 or the support body 150 includes a means for ensuring that the support body 150 and the tube member 110 are aligned before the support body 150 is lowered into engagement with the tube member 110. A camera, a GPS, a laser or combination thereof is coupled to the support body 150 or the platform 20 for determining the position of the platform 20 and the support body 150 coupled thereto relative to the tube member 120 to ensure that when the support body 150 is lowered the end 111 of the tube member 110 is received within the recess 151 of the support body 150.

The means for determining the position of the platform 20 and the support body 150 coupled thereto relative to the tube member 110 in the bore hole 2 enables the platform 20 to be translated relative to the tube member 110 to completely clear the end 111 of the tube member 110 and to be repositioned once again to engage the tube member 110. Accordingly, the guard cage or other physical barriers provided around the bottom of the mast 30 can clear the tube member 110 to enable the insertion of the collar support apparatus 200 into the internal passage 120 of the tube member 110, manually or otherwise, and the platform 20 can be translated back to be repositioned to reengage and remove the tube member 110 from the bore hole 2.

The means for determining the position of the platform 20 and the support body 150 coupled thereto relative to the tube member 110 is configured to determine when the tube member 110 is aligned with the support body 150 which is also aligned with the axis of the drill string 40.

Figure 3:
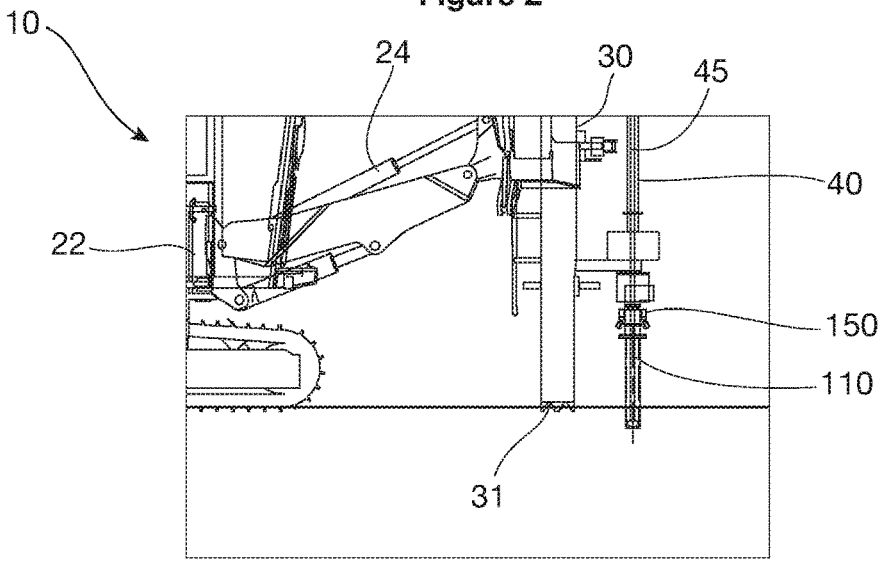

FIGS. 2 to 10 illustrate steps in a method in which the system 10 is used. In FIG. 2 an operator manoeuvres the platform 20 into position adjacent to the location at which a bore hole 2 is to be drilled. As illustrated in FIG. 3 the mast 30 is lowered and the foot pad 31 is lowered down on the bench surface. The drill string 40 is also fed down through the through tube member 110. The drill head 25 is activated and because the top layer of material is preconditioned the drill bit 47 penetrates relatively easily.

Figure 4:
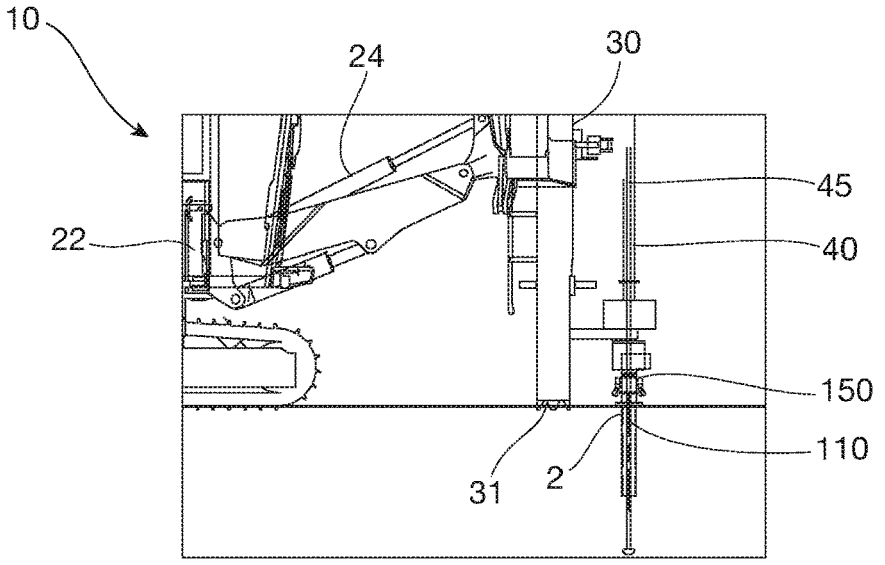

As illustrated in FIG. 4, the linear actuator is operated to cause the support body 150 and the tube member 110 coupled thereto to penetrate the bench surface until the lower surface 118 of the flange 115 engages the surface of the bench 6 surrounding the bore hole 2. The bore hole 2 is then drilled to the desired depth while the tube member 110 remains in the collar region of the bore hole 2.

Figure 5:
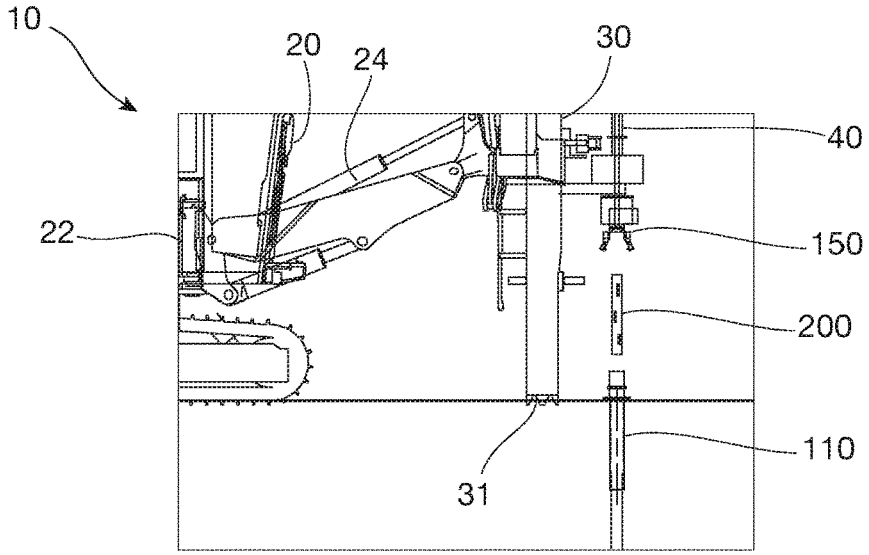

As illustrated in FIG. 5 the drill string 40 is withdrawn from the bore hole 2 and the support body 150 is disengaged from the tube member 110 and is raised upwards to completely clear the end 111 of the tube member 110 to enable the insertion of the collar support apparatus 200 into the internal passage 120 of the tube member 110.

Figure 6:
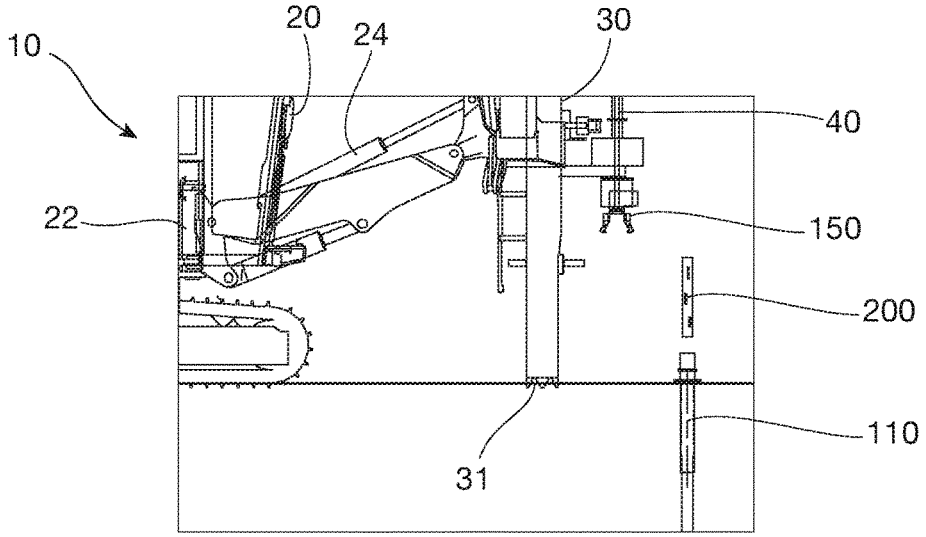

In another embodiment illustrated in FIG. 6, the platform 20 is translated relative to the tube member 110 to completely clear the end 111 of the tube member 110 to enable the insertion of the collar support apparatus 200 into the internal passage 120 of the tube member 110.

Figure 7:
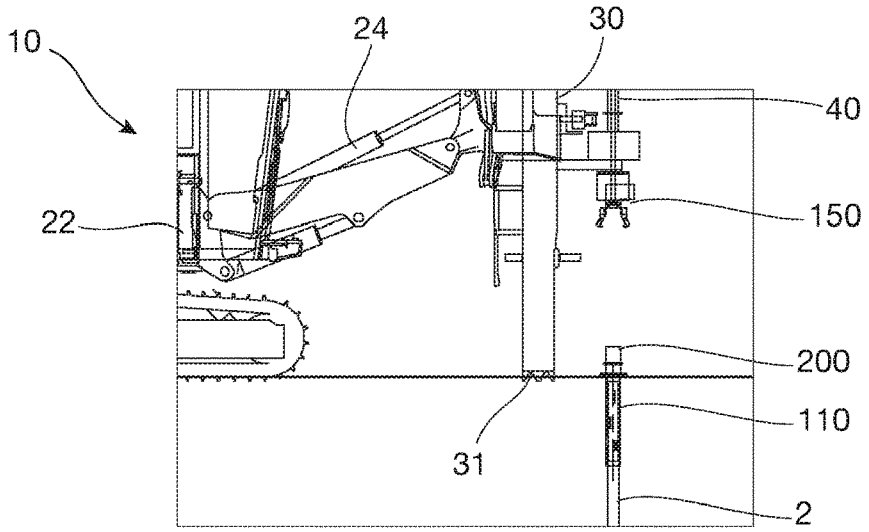
Figure 8:
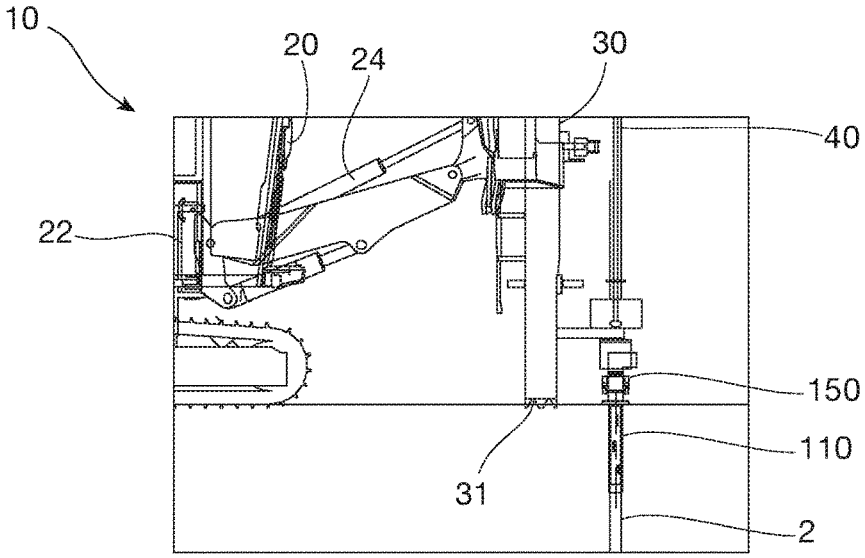
Figure 9:
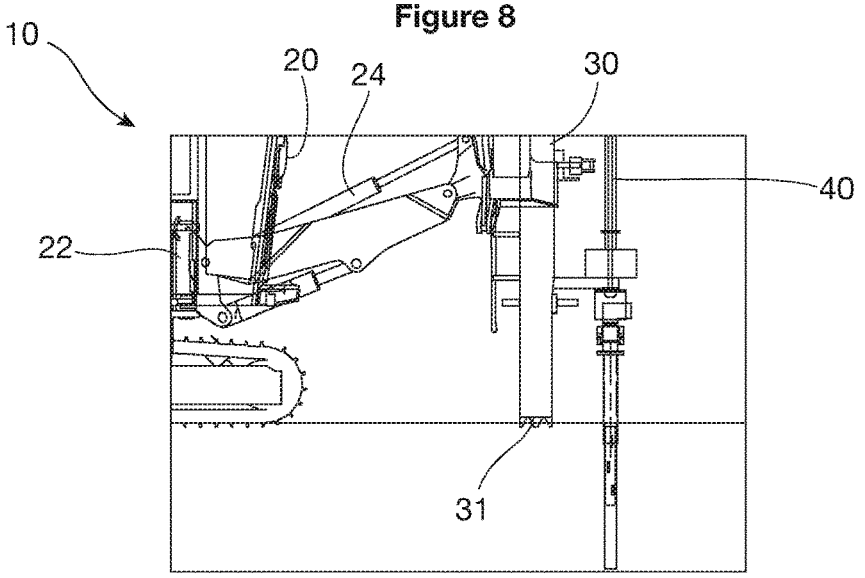
Figure 10:
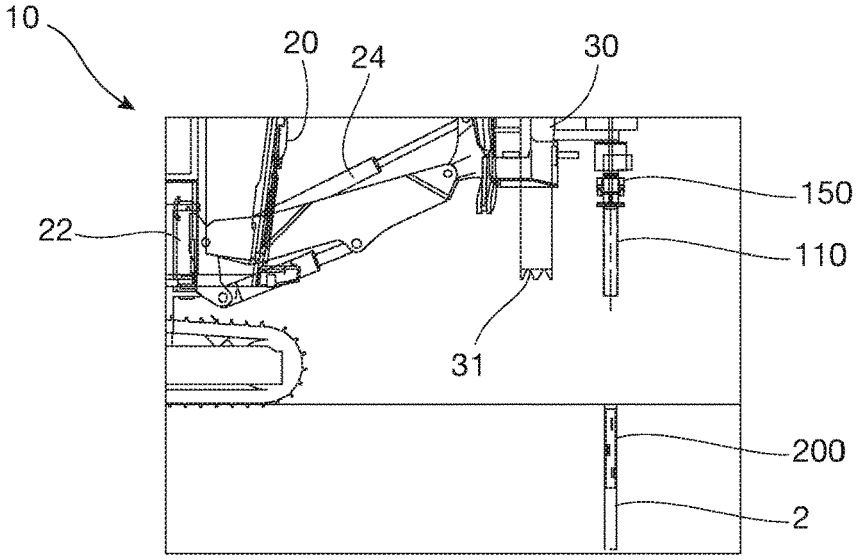
Figure 11:
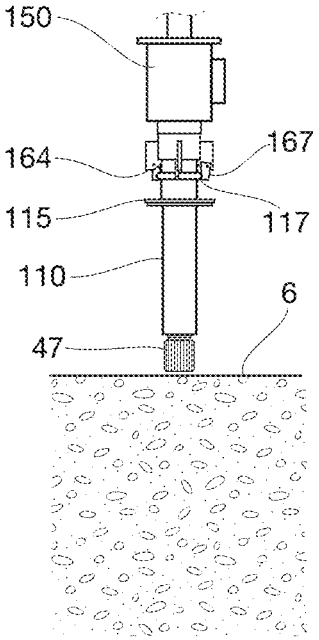
FIGS. 11 to 19 illustrate a sequence of steps in a method of drilling a bore hole and providing a collar support apparatus into the bore hole in accordance with an embodiment of the invention by reference to a set of side views of a portion of the coupling mechanism and the tube member of FIG. 1.
Figure 12:
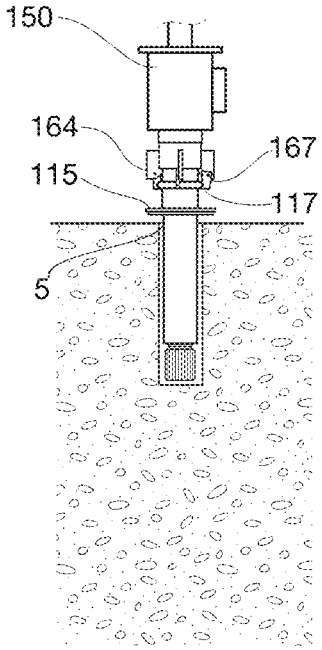
Figure 13:
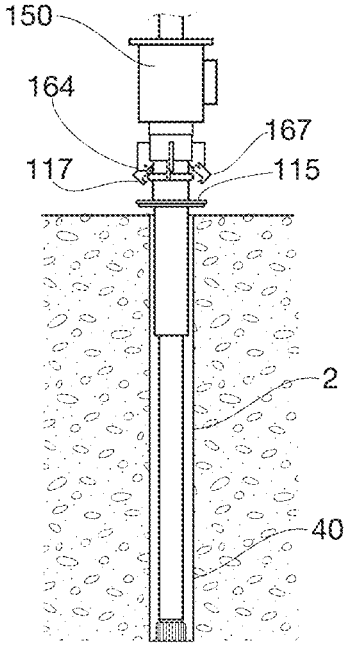
Figure 14:
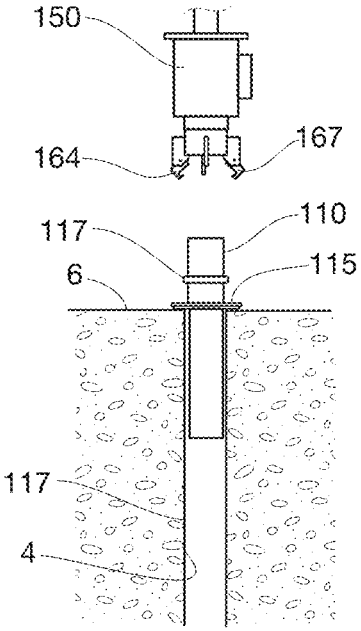
Figure 15:
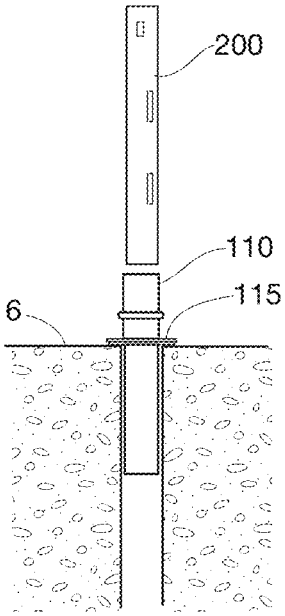
Figure 16:
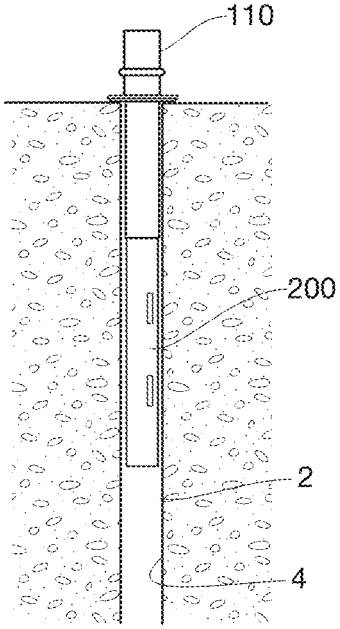
Figure 17:
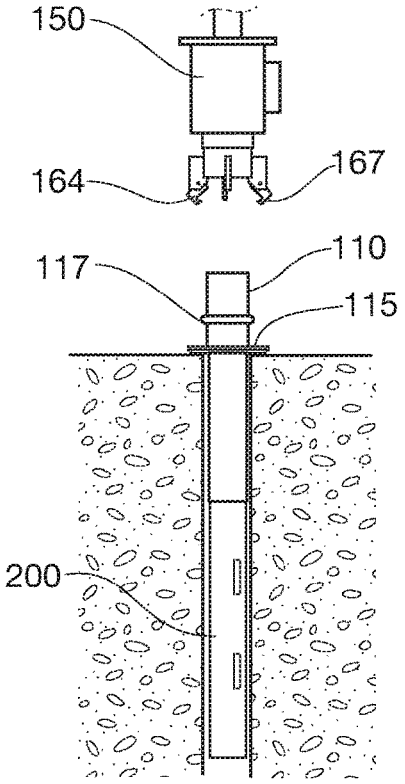
Figure 18:
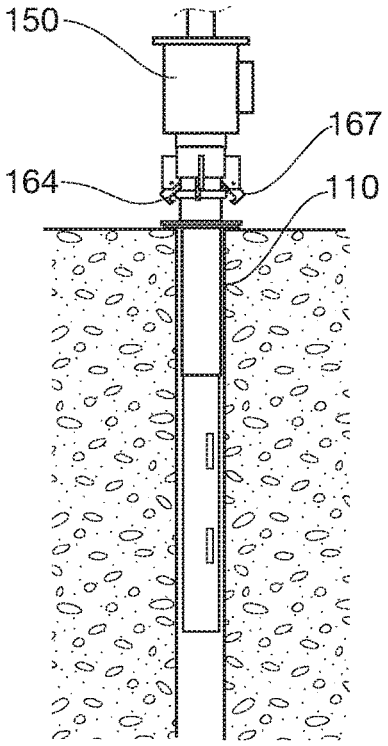
Figure 19:
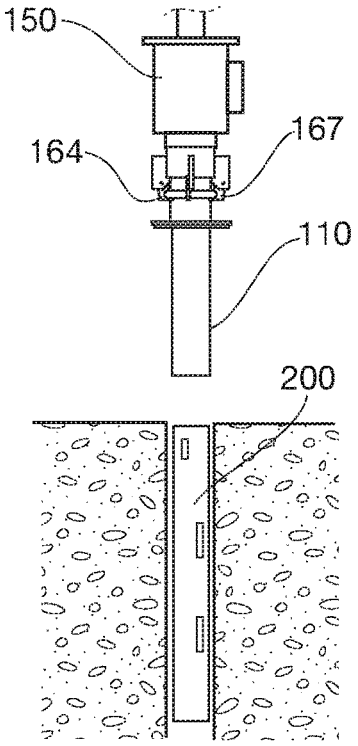

In FIG. 7 the platform 20 is repositioned relative to the tube member 110 to align the support body 150 and the tube member 110 and in FIG. 8 the support body 150 is lowered to reengage the tube member 110. In FIG. 9 the support body 150 and the tube member 110 coupled thereto are lifted out of the bore hole 2 and subsequently in FIG. 10 the mast 30 is raised and the foot pad 31 is also raised from the bench surface. The platform 20 may then be maneuvered to the location at which a subsequent bore hole 2 is to be drilled.

FIGS. 11 to 19 illustrate an enlarged view of the support body 150 and the tube member 110 performing the sequence of steps of the method described above.

Figure 20:
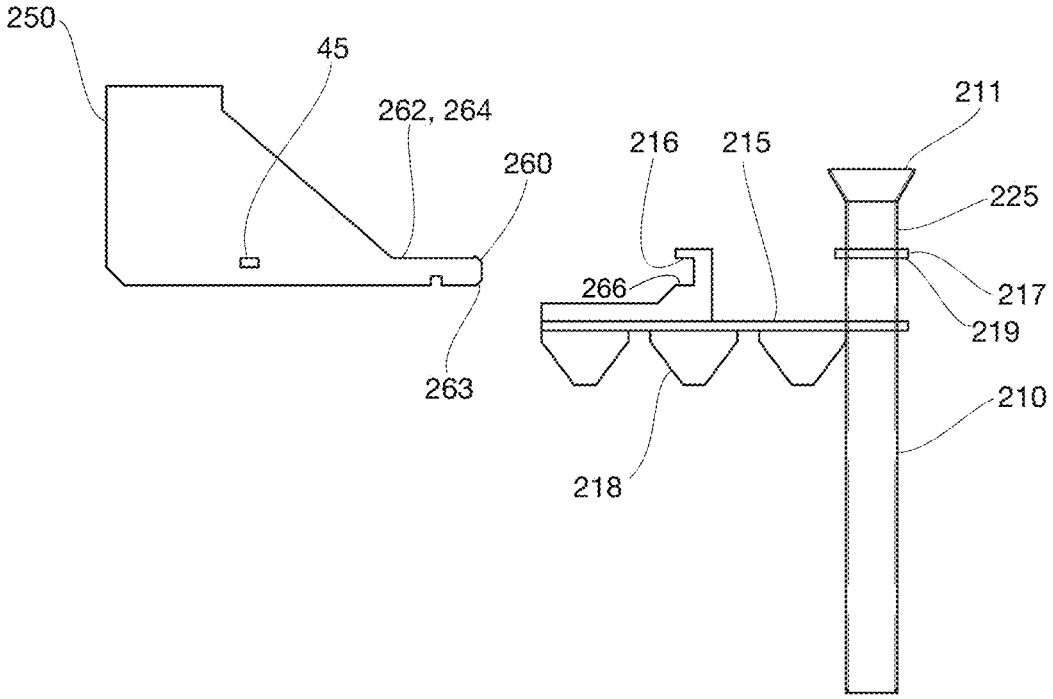
FIG. 20 illustrates a side view of a tube member for locating coaxially within the collar region of a bore hole and a coupling mechanism that is configured to couple and decouple the tube member and a drilling platform in accordance with another embodiment of the invention.

FIG. 20 illustrates a side view of another embodiment in which the tube member 210 and the support body 250 are configured to engage and disengage upon movement of the support body 250 horizontally relative to the tube member 210 located within the collar region of the bore hole 2. The support body 250 and the tube member 210 include first and second horizontally spaced apart co-operable pairs of coupling elements adapted to releasably couple together the support body 250 and the tube member 210 located within the collar region of the bore hole 2.

The support body 250 includes a recess 260 formed in the support body 250, wherein the recess 260 is defined on laterally opposite sides by a pair of upwardly facing shoulders 262, 264 and an opening 263 at one end defining a female coupling zone. The tube member 210 includes an annular rib 217 on the external surface 225 located a distance away from an end 211 of the tube 210 of about 100 mm, or about 200 mm, or about 300 mm, or about 400 mm or any increment therebetween. As described in further detail below, the rib 217 includes a ledge 219 for face to face abutment with the upwardly facing shoulders 262, 264 when the tube member 210 is within the recess 260 of the support body 250.

The tube member 110 also includes a flange 215 extending from the external surface 225. The flange 215 is located further from the end 211 of the tube member 210 than the rib 217. The flange 215 is comprised of a plate which may be welded or otherwise fixed or formed integral with the external surface 225 of the tube member 210. The flange 215 illustrated in the Figures is a substantially planar, elongated member extending transversely from the external surface 225 of the tube member 210. A plurality of protrusions 218 project downwardly from the bottom surface of the flange 215.

An annular downwardly facing ledge disposed on a radially outwardly facing surface of the tube member defining a male coupling zone, wherein the male coupling zone is reversibly received within the female coupling zone with horizontal movement of the support body relative to the elongated tube located within the collar region of the bore hole.

The first pair of coupling elements are comprised of the tube member 210 and the recess 260 formed in the support body 250. In use, the tube member 210 is receivable within the recess 260 from a lateral direction. The second pair of coupling elements includes an upwards facing abutment surface 266 formed in the support body 250 that is horizontally spaced apart from the recess 260, and by a downwards facing abutment surface 216 coupled to, and vertically spaced apart from, the flange 215. The upwards and downwards facing abutment surfaces 266, 216 are reversibly brought into face to face relation with each other with lateral movement of the support body 250 relative to the tube member 210 located within the collar region of the bore hole 2.

FIGS. 21 to 28 illustrate a sequence of steps in a method of drilling a bore hole 2 and providing a collar support apparatus 200 into the bore hole 2 in accordance with an embodiment of the invention using the tube member 210 and the support body 250 of FIG. 20.

Figure 21:
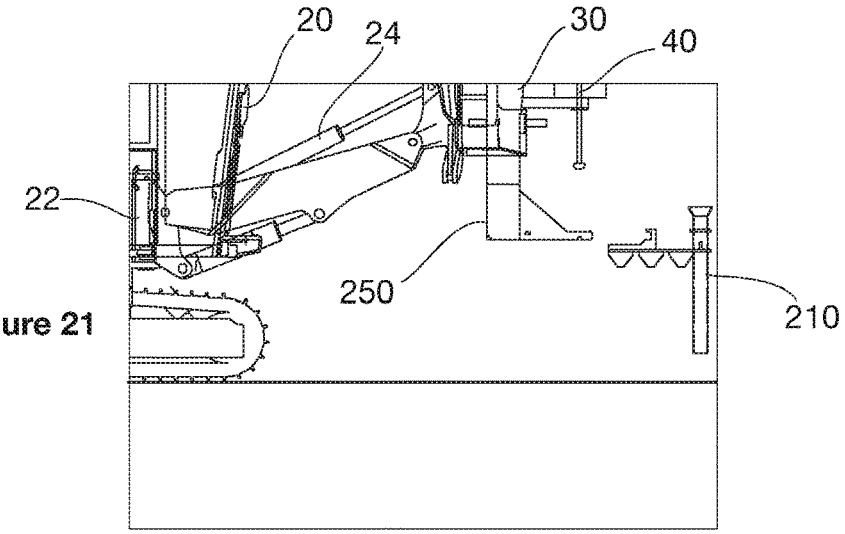
FIGS. 21 to 28 illustrate a sequence of steps in a method of drilling a bore hole and providing a collar support apparatus into the bore hole in accordance with an embodiment of the invention by reference to a set of side views of a portion of a drilling platform including a drill mast and the coupling mechanism and the tube member of FIG. 20.
Figure 22:
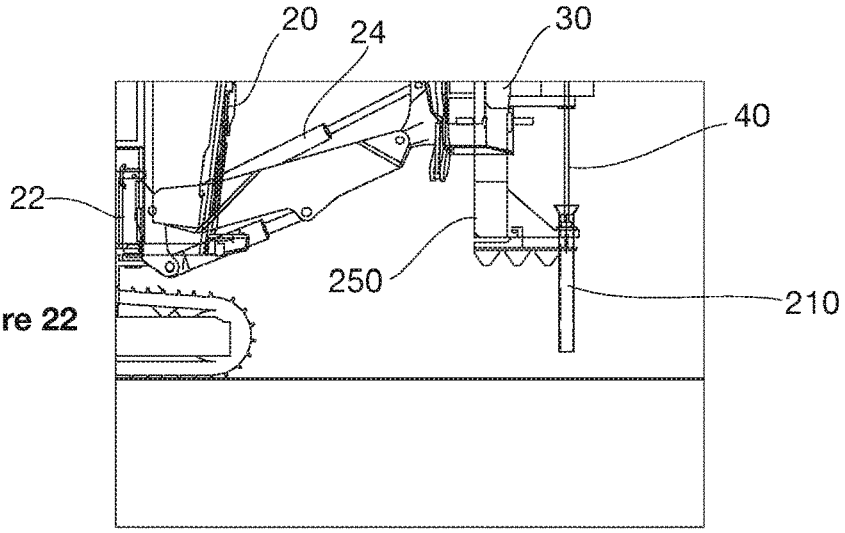
Figure 23:
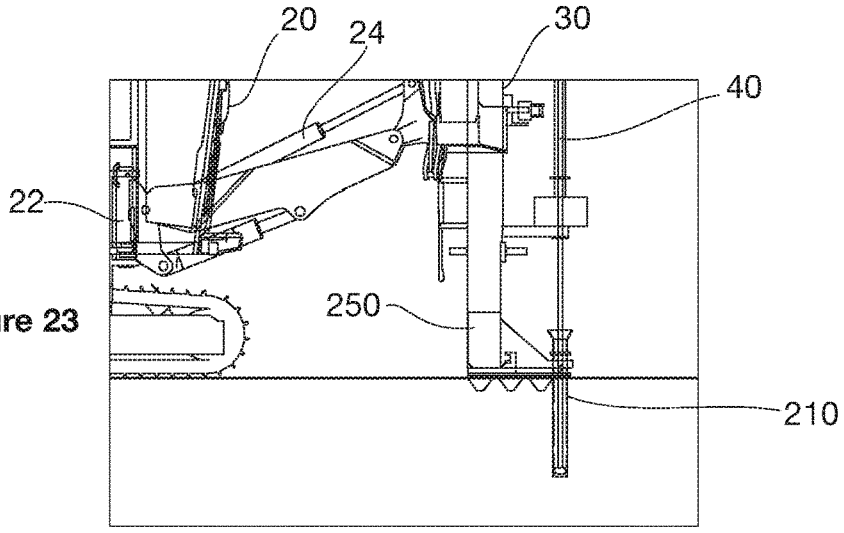
Figure 24:
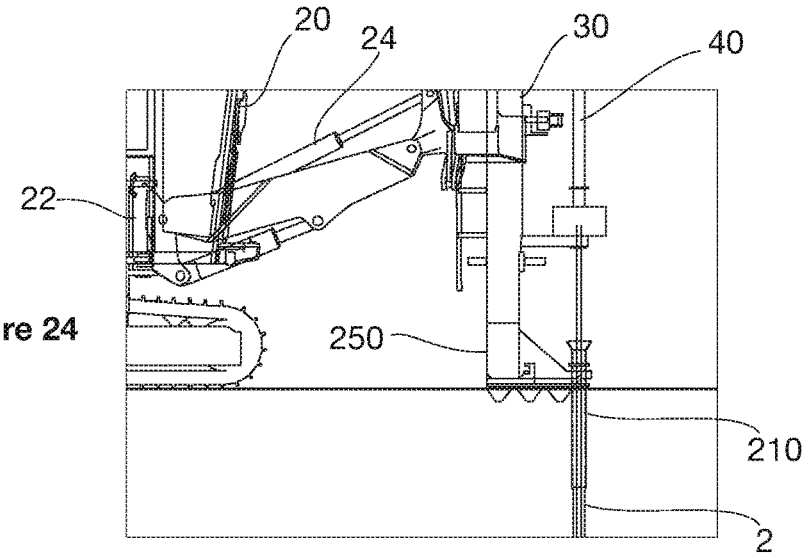

In FIG. 21 an operator manoeuvres the platform 20 into position to align the tube member 210 with the recess 260 in order to couple them together. In FIG. 22, the platform is maneuvered to a location at which a bore hole 2 is to be drilled. As illustrated in FIG. 23 the mast 30 is lowered and tube member 110 is thrust down through the bench surface until the protrusions 218 of the flange 215 engage the surface of the bench 6 surrounding the bore hole 2. In FIG. 24 the bore hole 2 is then drilled to the desired depth by the drill string 40 while the tube member 210 remains in the collar region of the bore hole 2.

Figure 25:
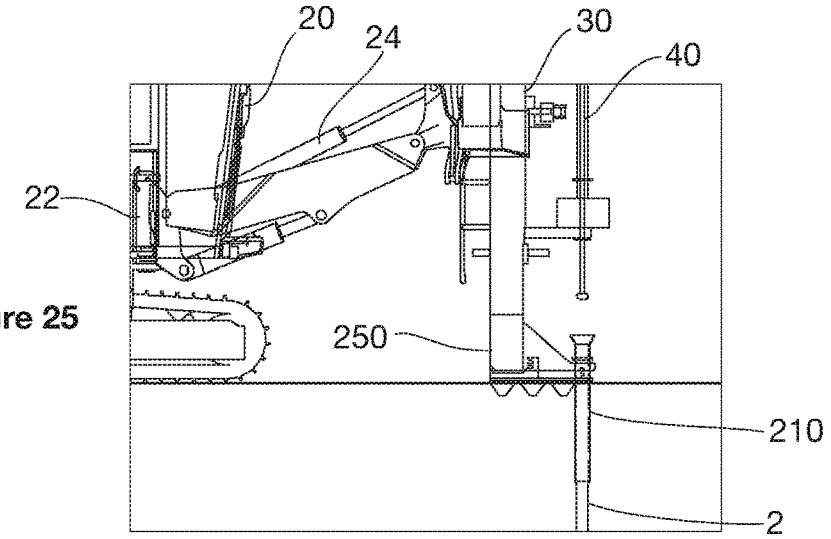
Figure 26:
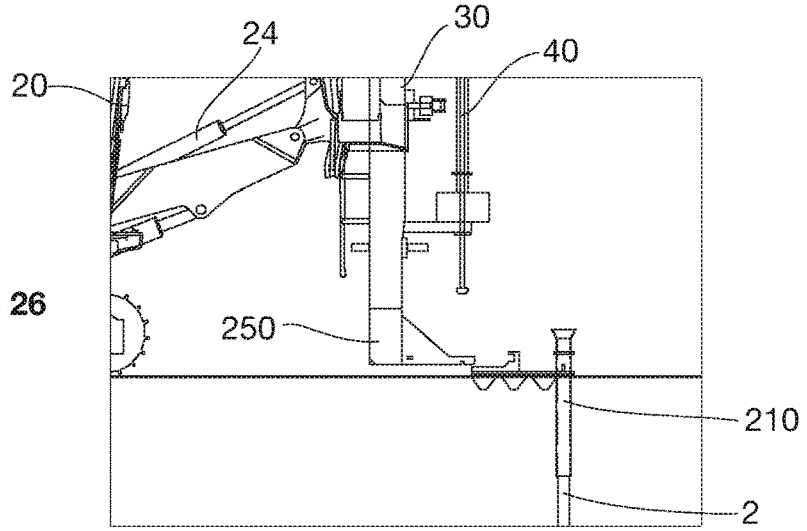

As illustrated in FIG. 25 the drill string 40 is withdrawn from the bore hole 2 and from the tube member 210. In FIG. 26, the platform 20 is translated laterally to disengage the tube member 210 and the support body 250. The tube member 210 is thereby offset from the axis of the drill string 40 and the support body 250, and any guard cage or other physical barriers provided around the bottom of the mast 30 can clear the tube member 110 to enable the insertion of the collar support apparatus 200 into the internal passage 120 of the tube member 110, manually or otherwise.

Figure 27:
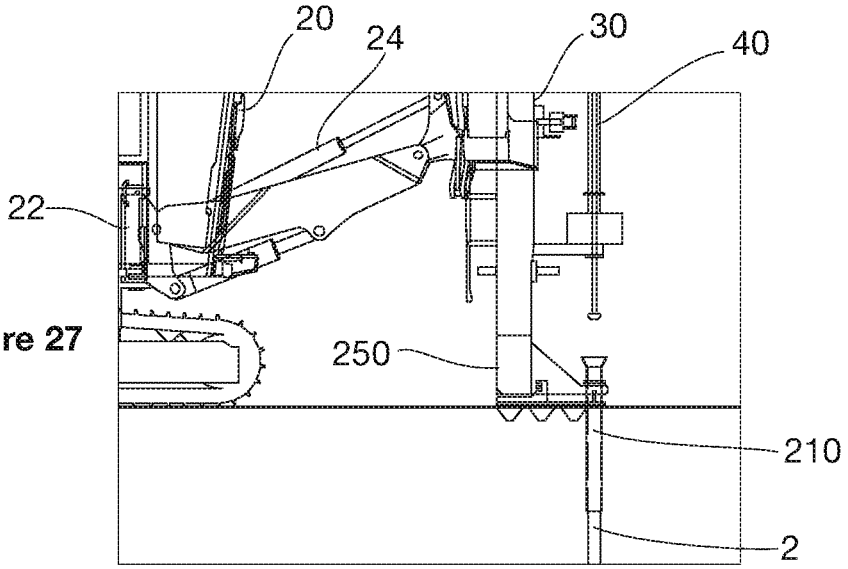
Figure 28:
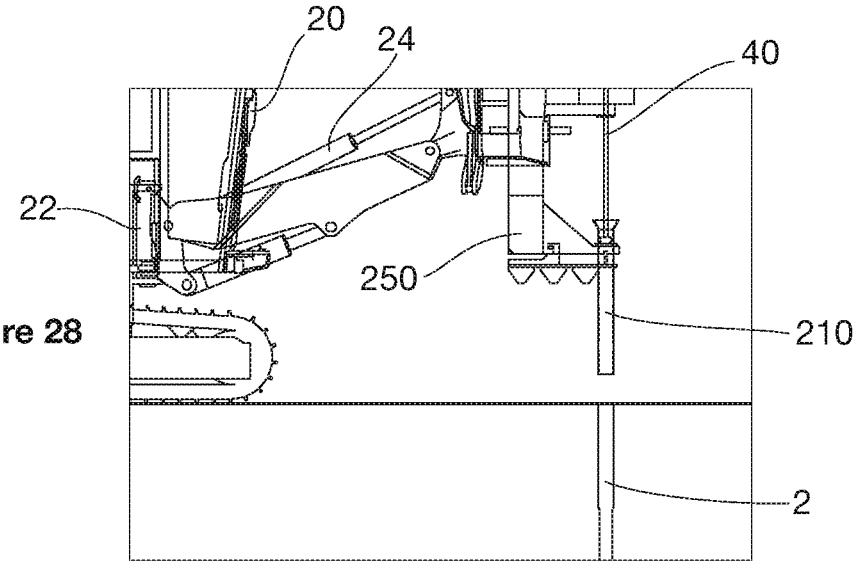

In FIG. 27 the platform 20 is translated in the opposite lateral direction to be repositioned to reengage the support body 250 and the tube member 210. In FIG. 28, the mast 30 is raised and the tube member 110 is drawn out from the bore hole 2 to leave behind the collar support apparatus 200 in the collar region of the bore hole 2.

In the embodiment of FIGS. 20 to 28, the coupling is adapted for permitting movement of the tube member 110 relative to the mast 30 between a position in which the tube member 110 is aligned with an axis of the drill string 40 and another position in which the tube member 110 is offset from the axis of the drill string 40 while the tube member 110 and the mast 20 remain coupled together.

Figure 29:
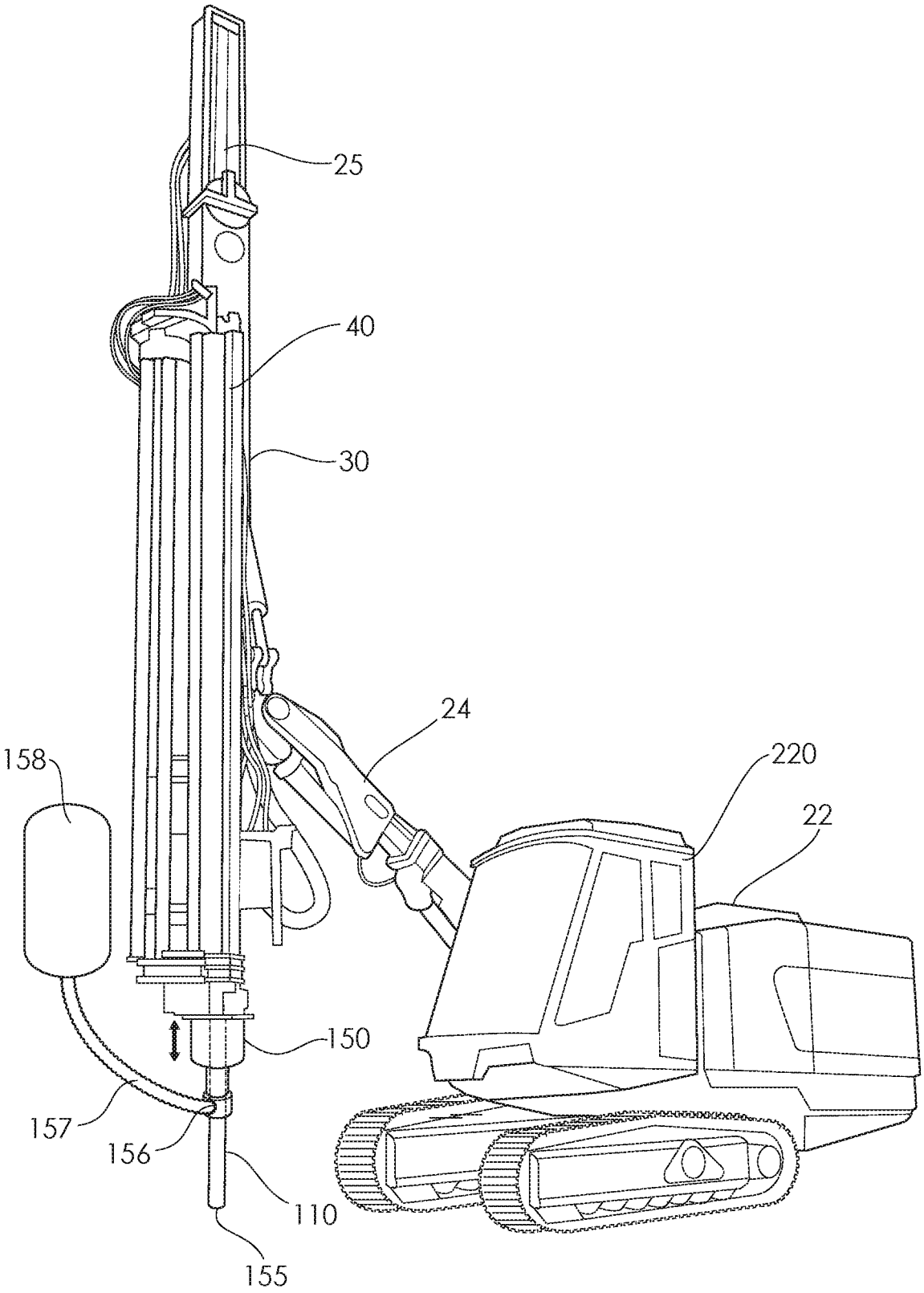
FIG. 29 illustrates an embodiment of the drilling platform further including a transverse outlet opening for the cuttings and/or bailings to exit the tube member, wherein the outlet opening is coupled to a flexible hose that in turn is coupled to a vacuum pump system to be directed to a desired location on the bench surface.

FIG. 29 illustrates an embodiment of the drilling platform 220 that is similar to the drilling platform 20 of FIGS. 1 to 10, and like reference numerals are used to identify like features. The drilling platform 220 of FIG. 20 comprises a self-propelled vehicle 22 including a hydraulic arm 24 that supports the mast 30. The mast 30 supports the drill string 40 and the support body 150. The support body 150 is movably connected to the drilling platform 220 and is configured to couple and decouple with the tube member 110 whilst the tube member 110 is substantially axially aligned with the drill string 40.

The support body 150 includes a transverse outlet opening 156 for the cuttings and/or bailings to exit the axial opening or passage 155 within the support body 150 during drilling. The outlet opening 156 is coupled to a flexible hose 157 that in turn is coupled to a vacuum pump system 158. The vacuum pump system 158 includes an outlet hose (not shown) that directs the cuttings and/or bailings to a desired located on the bench surface.

Figure 30:
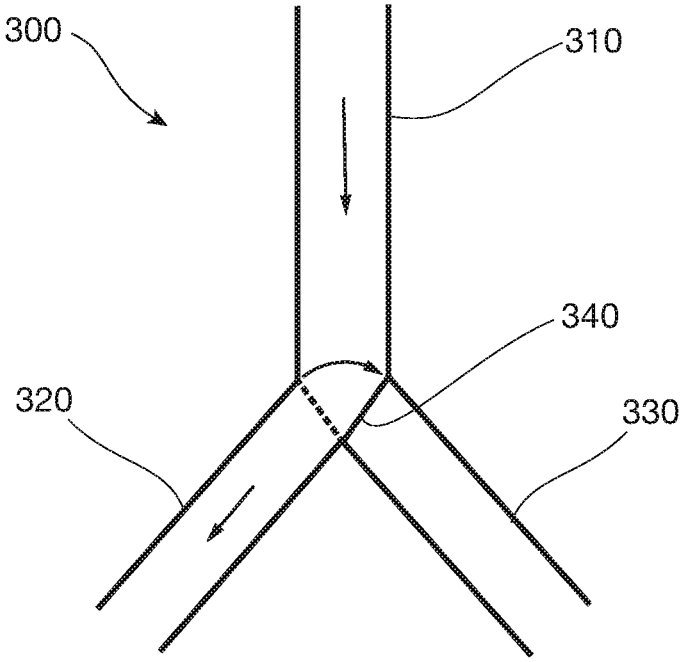
FIGS. 30 and 31 illustrate an embodiment of a flow diverter that is comprised in an embodiment of the drilling platform of FIG. 20 for directing dry cuttings and/or bailings into one outlet and wet cuttings and/or bailings into another outlet.
Figure 31:
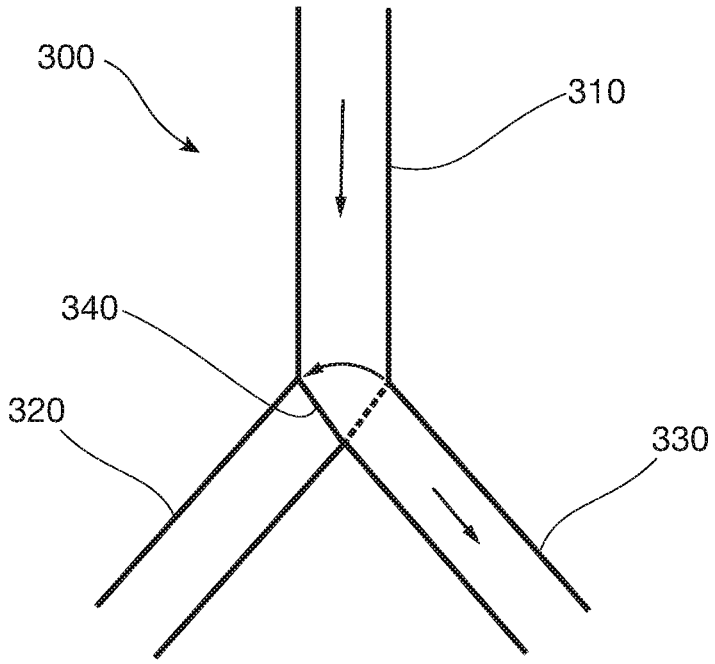

FIGS. 30 and 31 illustrate a flow diverter 300 that is adapted for inclusion in an embodiment of the drilling platform 220 of FIG. 20. The flow diverter 300 includes an inlet passage 310 that is adapted to be installed in line between the outlet opening 156 and the vacuum pump system 158. The flow diverter 300 includes two outlet passages 320, 330. A first one of the outlet passages 320 is adapted to be connected in line to the flexible hose 157 that directs the cuttings and/or bailings to the vacuum pump system 158. The vacuum pump system is suited only for receiving dry cuttings and/or bailings.

The flow diverter 300 includes a channelling vane 340 that is adapted to direct the cuttings and/or bailings to a respective one of the two outlet passages 320, 330 depending on whether the cuttings and/or bailings are wet or dry. The channelling vane 340 is actuated to selectively close either one of the outlet passages 320, 330 and thereby direct the cuttings an/or bailings into the other one of the outlet passages 320, 330. In embodiments, the flow diverter 300 includes an automated sensor for detecting moisture and automatically controlling the channelling vane 340 to direct dry bailings and/or cuttings to the first one of the outlet passages 320 that directs the cuttings and/or bailings to the vacuum pump system 158, and to direct wet bailings and/or cuttings to the other one of the outlet passages 330. The outlet passage 330 directs the wet bailings and/or cuttings onto the bench surface.

In an embodiment, the flow diverter 300 incorporates an X-ray fluorescence analyser (not shown) for analysing the elemental chemistry of the bailings and/or cuttings that emerge from the bore hole 2 via the outlet opening 156. The analyser determines sample groups of elements simultaneously in order to rapidly determine those elements present in the sample and their relative concentrations. In an embodiment, the analyser is configured to analyse the bailings and/or cuttings as they pass through the outlet passage 320 for the dry bailings and/or cuttings. In another embodiment, the flow diverter 300 includes another sampling outlet (not shown) that is configured to direct a sample of the bailings and/or cuttings to a sampling zone (not shown) that is adapted to hold a stationary sample for analysis by the analyser.

In an embodiment, the sample may be obtained by pausing the drilling head 25 when the drilling string 40 is at a desired depth and allowing a blower (not shown) configured to blow pressurised air through the drilling string 40 into the bore hole 2 to evacuate and purge any bailings or cuttings. The drilling head 25 is then restarted and the flow diverter 300 is configured to divert any bailings and/or cuttings that emerge through the sampling outlet to the sampling zone where they can be analysed.

Obtaining and analysing samples of the rock at certain depths within the bore hole is advantageous as it provides composition data that can be fed into blasting and excavation models to enhance the accuracy of the operation and to minimise dilution and avoid undesirable lowering of the ore grade associated with the mixing of waste material.

FIGS. 32 to 49 illustrate another embodiment of the bore hole drilling system 1010. Like terms are used to identify like features as between the embodiments of FIGS. 32 to 49 and the aforementioned embodiment of FIGS. 1 to 10 and where appropriate like reference numerals.

Referring to FIGS. 32 to 49 the tube member 1110 for locating within the collar region of a bore hole 2 includes an internal longitudinal passage 1120 for receiving the drill string 40 therethrough and an external surface 1125 for facing outwardly against a wall 4 of the bore hole 2. The system 10 includes a coupling mechanism 1140 that is configured to couple and decouple the tube member 1110 and the drilling platform 20 when the tube member 1110 is located coaxially within the collar region of the bore hole 2.

The coupling mechanism 1140 includes a support body 1150 that is adapted to be movably connected to the drilling platform 20. The support body 1150 includes a housing 1152 and coupling elements comprised of movable latch members 1164, 1167. The movable latch members 1164, 1167 are comprised of elongated members or legs 1164*a*, 1167*a*. The elongated members 1164*a*, 1167*a* are attached by a pivotal coupling 1161, 1163 to the support body 1150. The pivotal coupling 1161, 1163 is at one end of the elongated members 1164*a*, 1167*a*. The recess 1151 defined between the latch members 1164, 1167 has a central longitudinal axis that is aligned with the longitudinal axis of the drill string.

At the other end of each of the elongated members 1164*a*, 1167*a* there is a transversely extending part 1165*a*, 1168*a* that extends radially inwards towards the central longitudinal axis of the recess 1151. The transversely extending parts 1165*a*, 1168*a* define the axially facing abutment surfaces 1165, 1168.

The annular rib 1117 on the external surface 1125 of the tube member 1110 has a bottom surface that defines a downwardly facing annular ledge 1119 and an upper surface 1118 that slopes downwardly and away from the external surface 1125 of the tube member 1110. The upper surface 1118 and the annular ledge 1119 meet at a radially outermost edge of the annular ledge 1119.

Linear hydraulic or pneumatic actuators 170, 172 are connected to the elongated members 1164*a*, 1167*a* at a location between the ends thereof. The linear hydraulic or pneumatic actuators 1170, 1172 are connected at one end 1171, 1173 to each of the elongated members 1164*a*, 1167*a* and at an opposite end 1175, 1177 to a top plate 1178 of the support body 1150.

As illustrated in FIG. 32 to 35, the actuators 1170, 1172 are adapted to retract or shorten in length. The elongated latch members 1164*a*, 1167*a* thereby pivot about the pivotal couplings 1161, 1163 which in turn causes the transversely extending parts 1165*a*, 1168*a* and the axially facing abutment surfaces 1165, 1168 to move radially outwardly to thereby open up the recess 1151 defined therebetween.

The support body 1150 includes a plurality of guide members disposed radially about the recess 1151. The guide members are comprised of guide plates 1153, 1154 that are affixed to and extend downwardly from the housing 1152. The guide plates 1153, 1154 are located radially about the axial opening or passage 1155 within the housing 1152. The guide plates 1153, 1154 respectively include a tapered surface 1153*a*, 1154*a*. The tapered surfaces 1153*a*, 1154*a* defines an opening therebetween that tapers from a wider diameter at a lowermost level and to a narrower diameter at an uppermost level immediately adjacent to the axial opening 1155 within the housing 1152.

The tapering opening defined between the tapered surfaces 1153*a*, 1154*a* of the guide plates 1153, 1154 is adapted to guide the end 1111 of the tube member 1110 into the recess 1151 defined between the latch members 1164, 1167. Accordingly, in use, the operator need only achieve an approximate alignment of the tube member 1110 with the recess 1151 and upon lowering the support body 1150 down on the tube member 1110 the guide plates 1153, 1154 serve to guide the tube member 1110 into alignment with the axial opening 1155 within the housing 1152.

Figure 32:
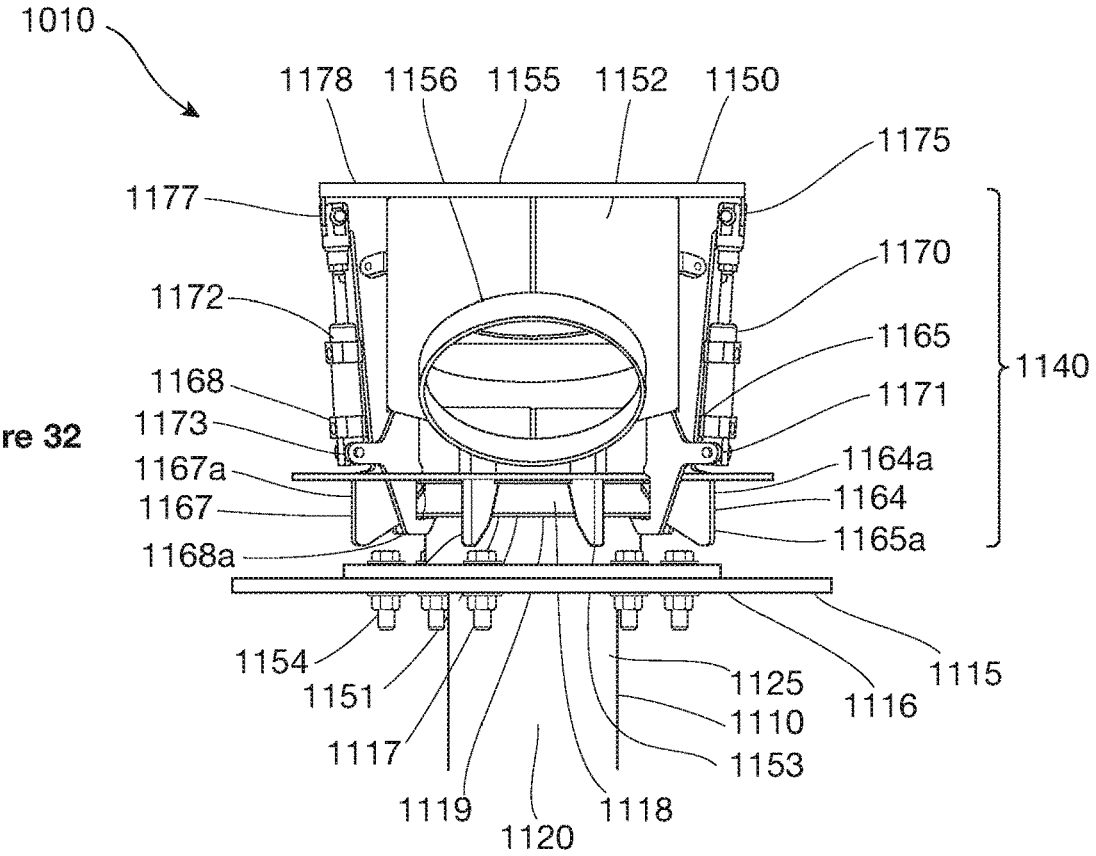
FIGS. 32 and 34 illustrate side views of a portion of a tube member and a support body including a coupling mechanism configured to couple and decouple the tube member and a drilling platform in accordance with another embodiment of the invention wherein the tube member and the support body are coupled together.
Figure 33:
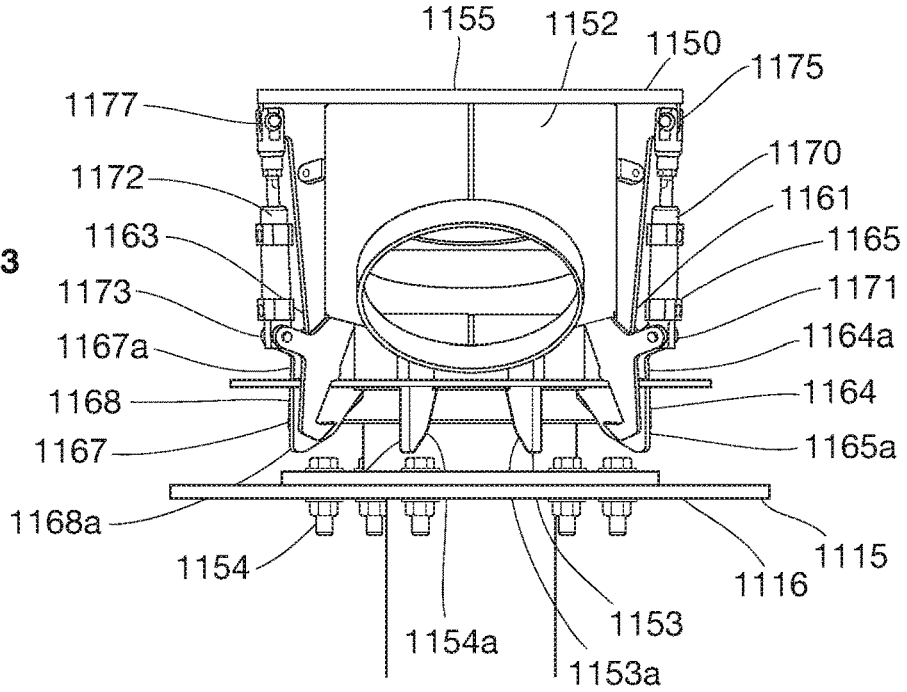
FIGS. 33 and 35 illustrate side views of the coupling mechanism and the tube member of FIGS. 32 and 34 wherein the tube member and the support body are decoupled.

As illustrated in FIG. 32, when the tube member 1110 is fully received within the recess 1151 the end 1111 of the tube member 1110 abuts with and practically seals against an axially extending part of an internal surface 1159 within the housing 1152. The internal passage 1120 of the tube member 1110 and the axial passage 1155 within the housing 1152 of the support body 1150 are thereby sealed together in fluid communication with each other.

The sloping upper surface 1118 of the rib 1117 of the tube member 1110 abuts against the tapered surfaces 1153*a*, 1154*a* of the guide plates 1153, 1154 to limit the extent of insertion of the end 1111 of the tube member 1110 into the housing 1152 of the support body 1150.

Figure 34:
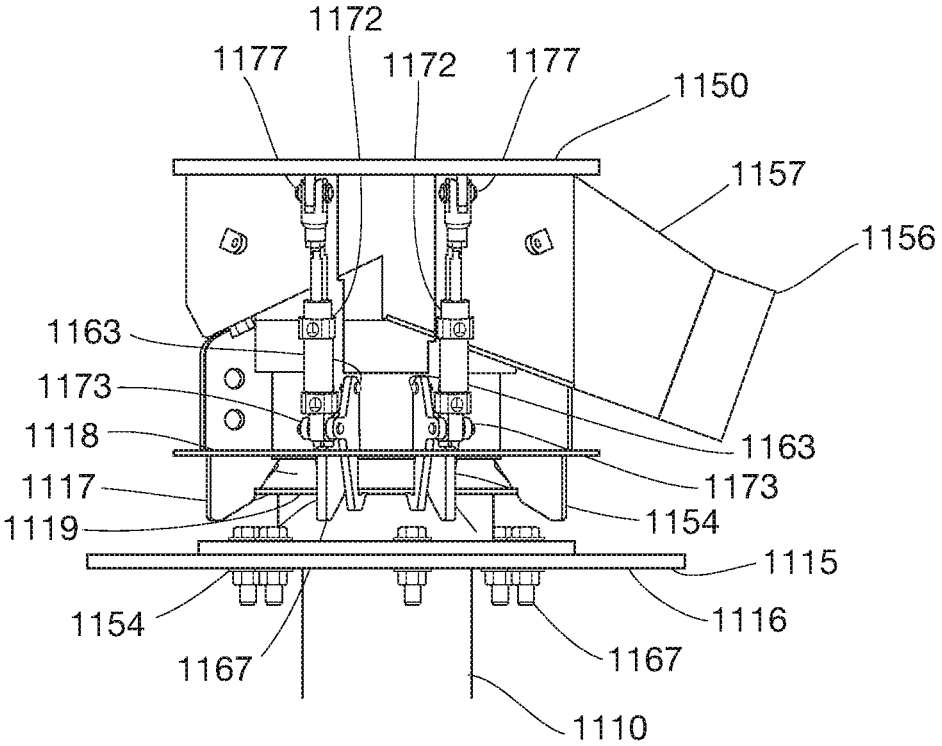
Figure 35:
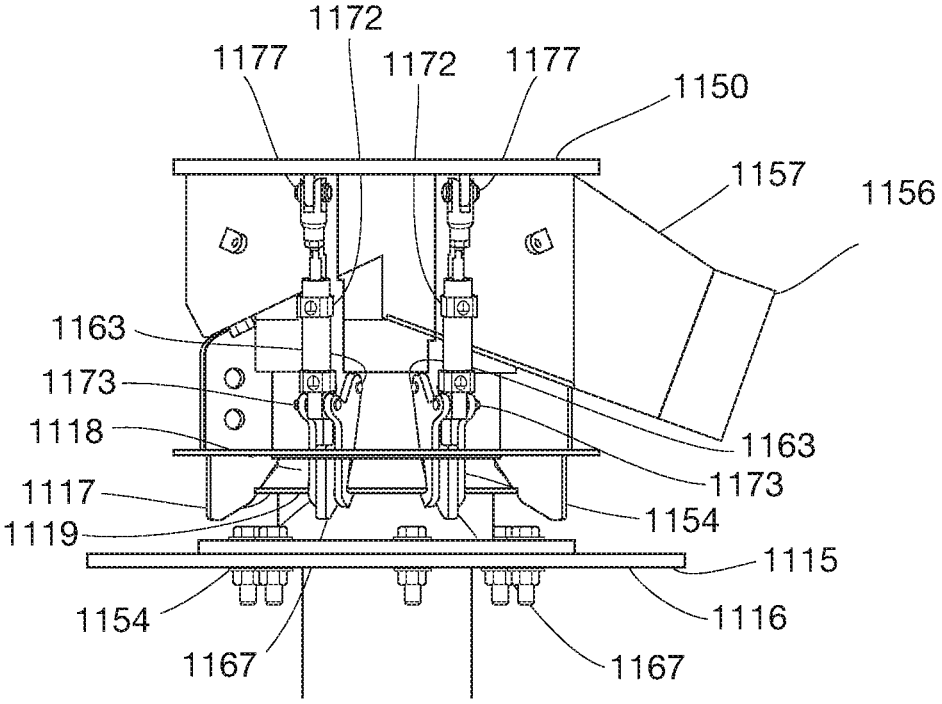
Figure 36:
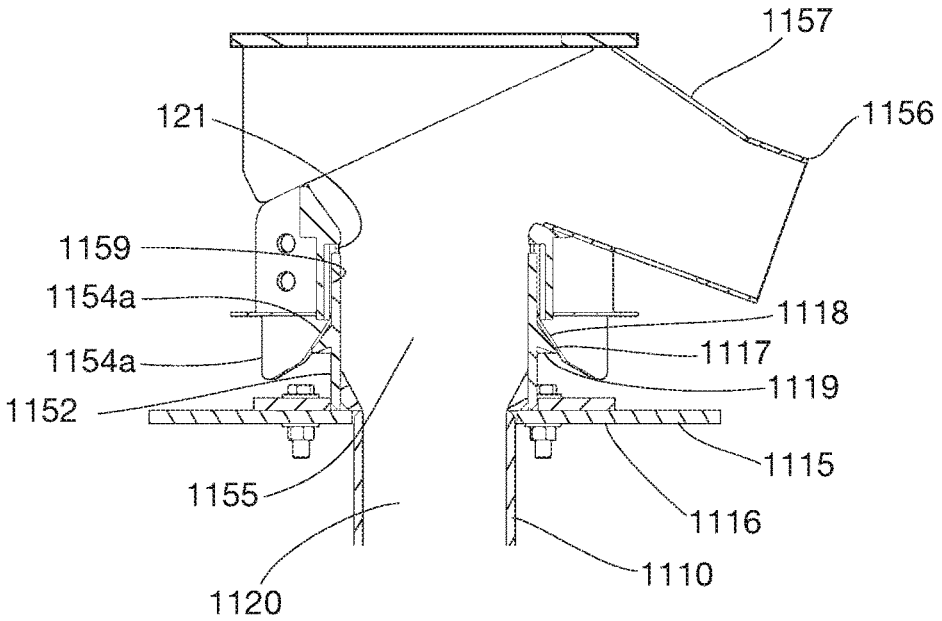
FIG. 36 illustrate a side section view of the coupling mechanism and the tube member of FIGS. 32 and 34 wherein the tube member and the support body are coupled together.

As illustrated in FIGS. 32 and 34, the actuators 1170, 1172 are operated to extend and thereby increase in length which in turn causes the latch members 1164*a*, 1167*a* to pivot about the pivotal couplings 1161, 1163, which causes the transversely extending parts 1165*a*, 1168*a* and the axially facing abutment surfaces 165, 168 to move radially inwardly, and thereby close together. Closure of the latch members 1164*a*, 1167*a* causes the axially facing abutment surfaces 1165, 1168 to come into face to face contact with the annular ledge 1119 of the rib 1117 on the tube member 1110 to thereby retain the support body 1150 and the tube member 1110 together.

Figure 38:
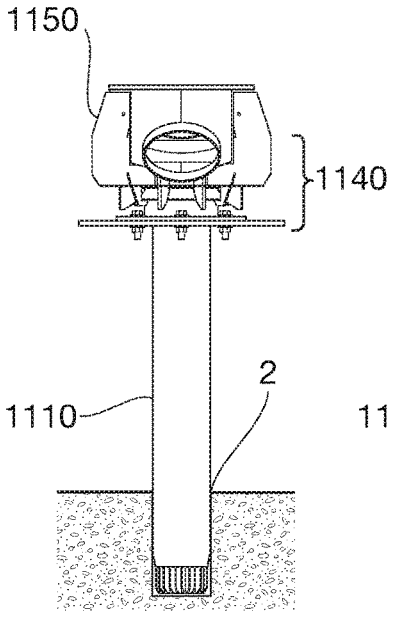
Figure 39:
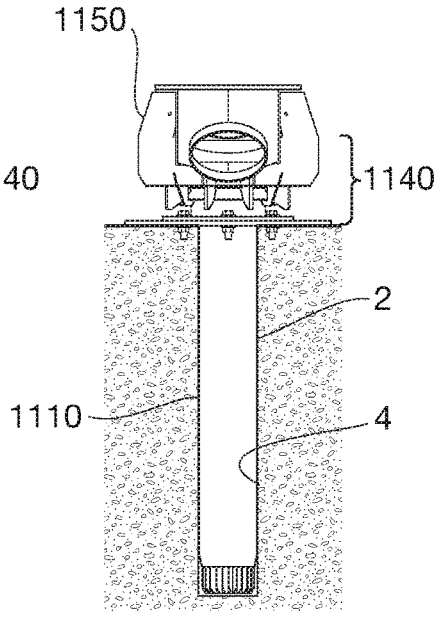
Figure 40:
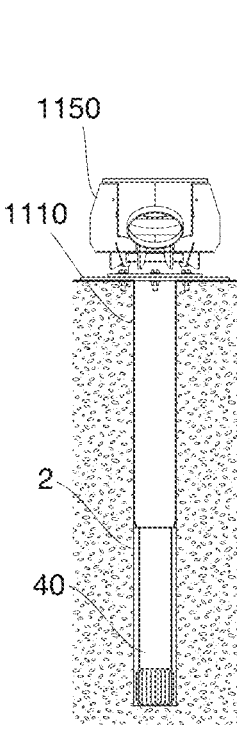
Figure 49:
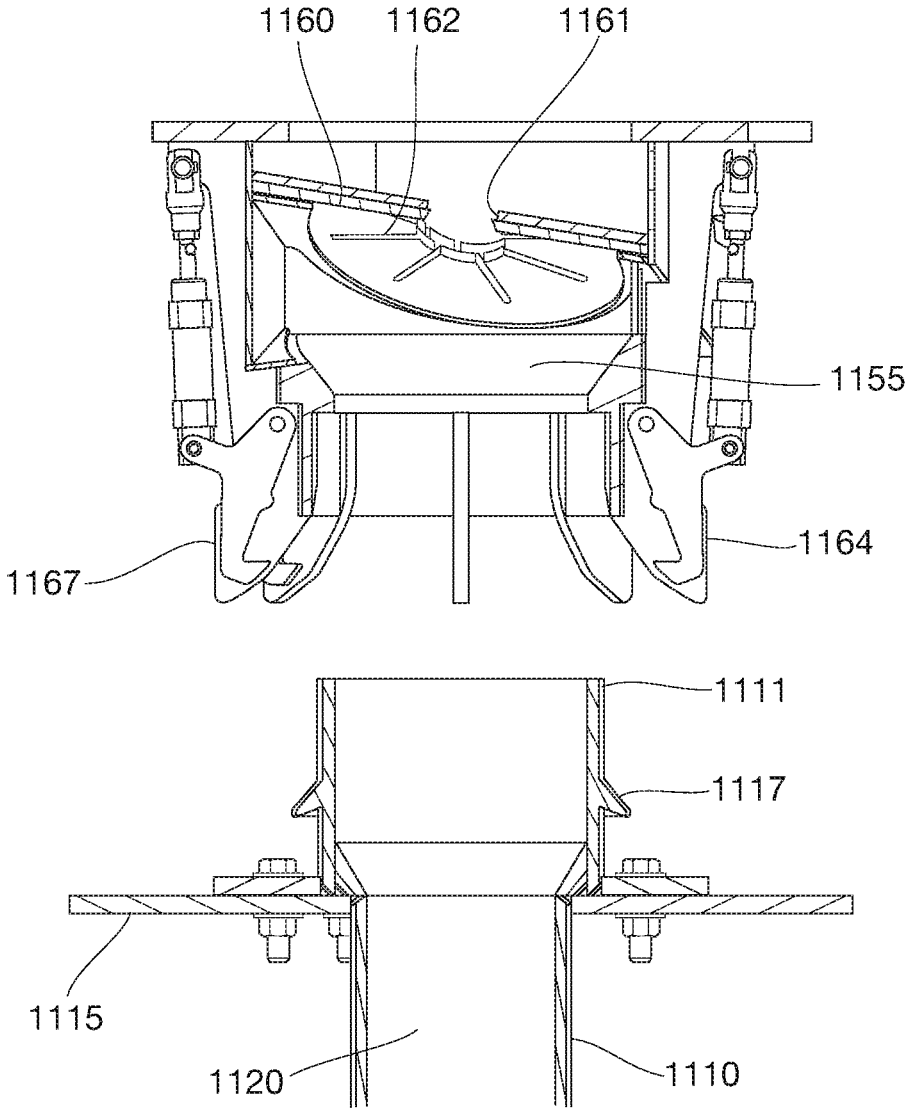

Referring to FIG. 49, a deflector plate 1160 is located within the housing 1152 of the support body 1150. The deflector plate 1160 is comprised of a thin, substantially planar sheet or panel member that is mounted within the housing 1152 and extends transversely across the axial opening or passage 1155 within the support body 1150. The plane of the deflector plate 1160 is oriented at an incline to the longitudinal axis of the axial passage 155. The plane of the deflector plate 1160 is oriented at an angle of between 15 and 75 degrees, or at an angle of between about 30 and 60 degrees or between about 40 and 50 degrees to the longitudinal axis of the axial passage 1155. As illustrated in FIGS. 38 to 40, the deflector plate 1160 includes a central opening 1161 that is aligned with and is adapted to receive the drill string 40 therethrough. A series of cuts 1162 are provided around the central opening 161 to enable the drill bit 47 at the end of the drill string to pass through the central opening 1161.

The housing 1152 of the support body 1150 includes a transverse outlet opening 1156 that is in fluid communication with the axial opening or passage 1155 within the support body 1150. The outlet opening 1156 includes an outlet pipe section 1157 that is integrated into the housing 1152. The pipe section 1157 is oriented outwards and slightly downwardly and can be connected to a conduit or the flexible hose 157 and vacuum pump system 158 of FIG. 29 and/or the flow diverter 300 of FIGS. 30 and 31.

In use, the cuttings and/or bailings are directed upwards and emerge from the bore hole 2 via the end 111 of the tube member 1110. As the internal passage 1120 of the tube member 1110 is sealed against the internal surface 159 within housing 1152 the cuttings and/or bailings that emerge from the bore hole 2 are directed up through the axial passage 1155 and are deflected by the deflector plate 1160 towards the outlet opening 1156.

As illustrated in FIGS. 39 and 40, the lower surface 1118 of the flange 1115 of the tube member 1110 engages the surface of the bench 6 surrounding the bore hole 2 and provides a substantial seal therewith. Likewise, the internal passage 120 of the tube member 1110 is sealed against the internal surface 159 within housing 1152. Thus, substantially all of the cuttings that emerge from the bore hole 2 are directed to the outlet opening 1156 and in turn are directed in a controlled manner to a desired location on the bench surface or for analysis.

Figure 37:
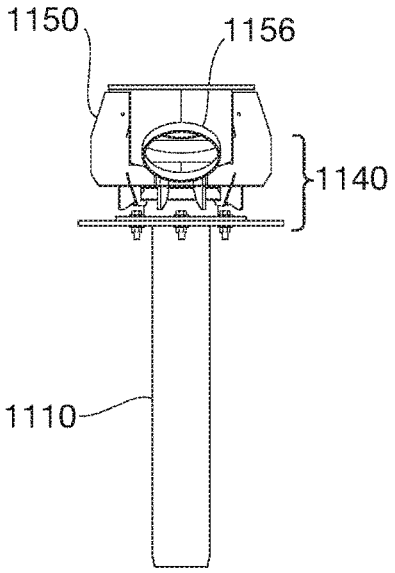
FIGS. 37 to 46 illustrate a sequence of steps in a method of drilling a bore hole and providing a collar support apparatus into the bore hole in accordance with an embodiment of the invention by reference to a set of side views of a portion of the tube member and the support body of FIGS. 32 and 34.

Referring to FIGS. 37 to 46, there is shown a method in which the system 1010 of FIGS. 32 to 36 and 47 to 49 is used. In FIG. 37 an operator manoeuvres the drilling platform into position adjacent to the location at which a bore hole 2 is to be drilled. As illustrated in FIGS. 37 and 38 the mast 30 is lowered and tube member 1110 is lowered onto the bench surface and the drill string 40 is also fed down through the through tube member 110. The drill head 25 is activated and because the top layer of material is preconditioned the drill bit 47 penetrates relatively easily.

As illustrated in FIG. 38, the support body 150 and the tube member 110 coupled thereto are caused to penetrate the bench surface until the lower surface 1116 of the flange 1115 engages the surface of the bench 6 surrounding the bore hole 2. As illustrated in FIG. 39 the bore hole 2 is drilled to the desired depth while the tube member 1110 remains in the collar region of the bore hole 2.

Figure 41:
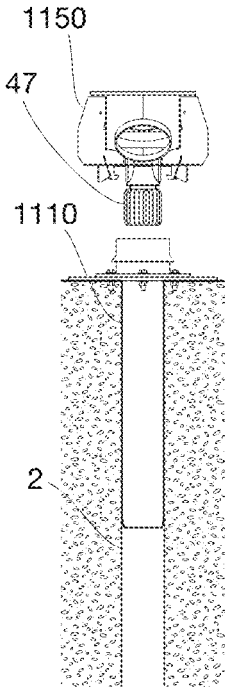
Figure 42:
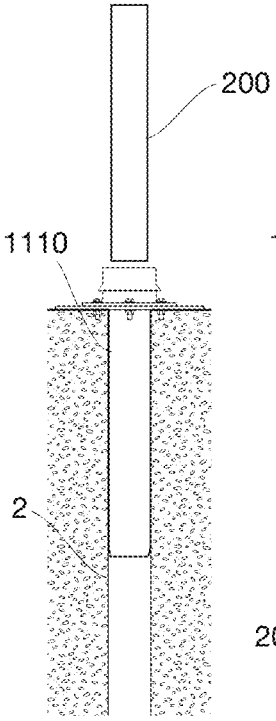

As illustrated in FIG. 40 the drill string 40 is withdrawn from the bore hole 2 and the support body 1150 is disengaged from the tube member 1110 and is raised upwards to completely clear the end 1111 of the tube member 1110 to enable the insertion of the collar support apparatus 200 into the internal passage 1120 of the tube member 1110 as illustrated in FIGS. 41 and 42.

Figure 43:
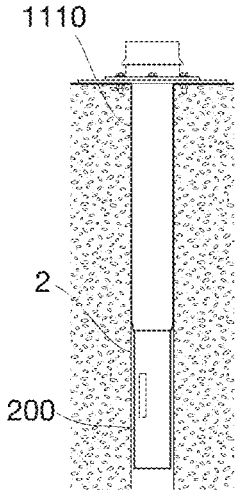
Figure 44:
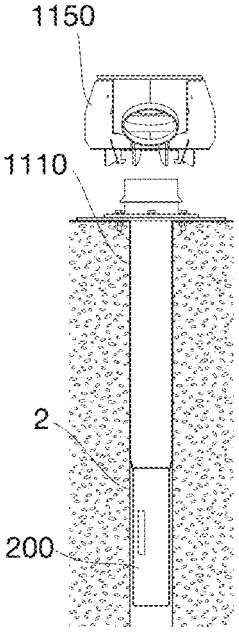
Figure 45:
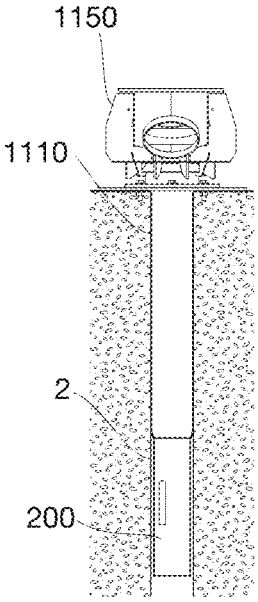
Figure 46:
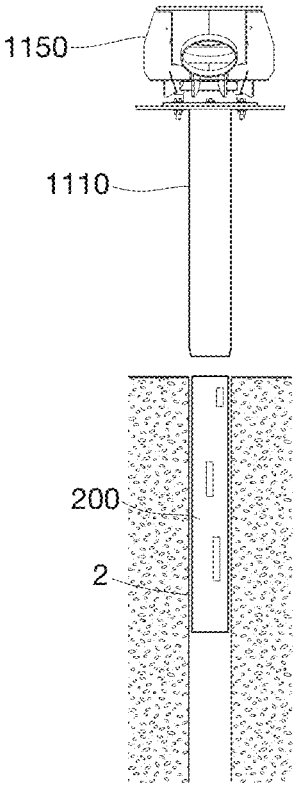

In FIG. 43 the support body 1150 is repositioned relative to the tube member 1110 to substantially align the support body 1150 and the tube member 1110 and in FIG. 44 the support body 1150 is lowered to re-engage the tube member 1110. In FIG. 45 the support body 150 and the tube member 1110 coupled thereto are lifted out of the bore hole 2 leaving behind the collar support apparatus 200 in the bore hole 2. The platform may then be maneuvered to the location at which a subsequent bore hole 2 is to be drilled.

Although the disclosure has been described with reference to specific examples, it will be appreciated by those skilled in the art that the disclosure may be embodied in many other forms, in keeping with the broad principles and the spirit of the disclosure described herein.

The invention claimed is:

1. A bore hole drilling system including:

a mobile bore hole drilling platform including a mast disposed on the platform, the mast including a support for a drill string;

a tube member for locating within a collar region of a bore hole and including an internal longitudinal passage for receiving a drill string therethrough and an external surface for facing outwardly against a wall of the bore hole;

a coupling mechanism that is configured to couple and decouple the tube member and the drilling platform when the tube member is located coaxially within the collar region of the bore hole and substantially axially aligned with the drill string and/or the mast;

wherein the coupling mechanism includes:

a support body movably connected to the drilling platform; and coupling elements including one or more movable latch members movably connected and disposed radially about a longitudinal axis of the support body and a static member that is fixed to the tube member;

the static member including a downwardly facing ledge and the latch members each comprising a radially movable and upwardly facing abutment portion adapted for face to face contact with the ledge upon relative radial movement of the latch member and the static member, and an elongated portion that is pivotally connected at one end to the support body and that is connected at an opposite end to the upwardly facing abutment portion, wherein the latch members are pivotable towards and away from each other for engagement and disengagement with the ledge;

wherein the support body is movable vertically relative to the drilling platform and/or the mast for positioning the coupling elements of the support body and the tube member relative to each other for engagement to thereby couple the support body and the tube member.

2. The bore hole drilling system of claim 1, wherein the coupling elements of the support body are configured to engage the coupling elements of the tube member with, at least in part, downwards axial movement of the support body relative to the tube member and to disengage, at least in part, with upwards axial movement of the support body relative to the tube member.

3. The bore hole drilling system of claim 1, wherein the support body includes a male or a female coupling zone and the tube member includes the other one of a male or a female coupling zone, wherein the male coupling zone is adapted to be received within the female coupling zone.

4. The bore hole drilling system of claim 1, wherein the one or more movable latch members and the static member are adapted to come into and out of engagement, at least in part, upon relative inwards and outwards movement of the one or more latch members and the static member.

5. The bore hole drilling system of claim 1, wherein the downwardly facing ledge of the static member is disposed circumferentially on the outside of the tube member.

6. The bore hole drilling system of claim 1, wherein linear actuators are operable to cause the latch members to pivot in opposite directions relative to the support body to cause the upwardly facing abutment surfaces to move radially inwardly and outwardly relative to each other.

7. The bore hole drilling system of claim 1, wherein a linear actuator is connected between the mast and the support body and is operable for moving the support body in opposite directions aligned with a longitudinal axis of the drill string and/or the mast.

8. The bore hole drilling system of claim 1, wherein the support body includes a transverse outlet opening for cuttings and/or bailings to exit the tube member.

9. The bore hole drilling system of claim 8, wherein the outlet opening is connected to a flow diverter for directing dry cuttings and/or bailings into one outlet and wet cuttings and/or bailings into another outlet.

10. The bore hole drilling system of claim 9, wherein the flow diverter is configured to direct a sample of the bailings and/or cuttings to a sampling zone for holding a stationary sample for analysis by an analyser.

11. The bore hole drilling system of claim 1, wherein the support body includes a plurality of guide members disposed radially about the longitudinal axis of the support body, wherein the guide members each comprise a guide plate including a tapering surface that tapers downwardly, wherein the tapering surfaces of the guide plates define an opening therebetween that tapers from a wider diameter at a lower level to a narrower diameter at an upper level.

12. A bore hole drilling system including:

a mobile bore hole drilling platform including a mast disposed on the platform including a support for a drill string;

a tube member for locating within a collar region of a bore hole and including an internal longitudinal passage for receiving a drill string therethrough and an external surface for facing outwardly against a wall of the bore hole;

a coupling mechanism that is configured to couple and decouple the tube member and the drilling platform when the tube member is located coaxially within the collar region of the bore hole and substantially axially aligned with the drill string and/or the mast, wherein the coupling mechanism includes a support body movably connected to the drilling platform and coupling elements associated with the support body and the tube member, wherein the support body is movable vertically relative to the drilling platform and/or the mast for positioning the coupling elements of the support body and the tube member relative to each other for engagement to thereby couple the support body and the tube member, the support body including a transverse outlet opening for cuttings and/or bailings to exit the tube member, and wherein the outlet opening is coupled to a flexible hose that in turn is coupled to a vacuum pump system to be directed to a desired location on a bench surface.

13. A bore hole drilling system including:

a mobile bore hole drilling platform including a mast disposed on the platform including a support for a drill string and accompanying percussion air blast drilling apparatus;

a tube member for locating within a collar region of a bore hole and including an internal longitudinal passage for receiving a drill string therethrough and an external surface for facing outwardly against a wall of the bore hole;

a coupling mechanism that is configured to couple and decouple the tube member and the drilling platform when the tube member is located coaxially within the collar region of the bore hole and substantially axially aligned with the drill string and/or the mast;

wherein the coupling mechanism includes a support body movably connected to the drilling platform and coupling elements associated with the support body and the tube member, wherein the support body is movable vertically relative to the drilling platform and/or the mast for positioning the coupling elements of the support body and the tube member relative to each other for engagement to thereby couple the support body and the tube member, wherein the percussion air blast drilling apparatus includes a blower configured to blow pressurised air through the drill string into the bore hole to evacuate and purge cuttings and/or bailings when drilling is paused, and wherein the support body includes a transverse outlet opening for the cuttings and/or bailings to exit the tube member.

* * * * *